US012796830B2

(12) United States Patent
Guo et al.

(10) Patent No.: US 12,796,830 B2
(45) Date of Patent: Nov. 17, 2026

(54) BABY BED

(71) Applicant: Wonderland Switzerland AG, Steinhausen (CH)

(72) Inventors: Zhengwen Guo, Steinhausen (CH); Huan Ning, Steinhausen (CH)

(73) Assignee: WONDERLAND SWITZERLAND AG, Steinhausen (CH)

( * ) Notice: Subject to any disclaimer, the term of this patent is extended or adjusted under 35 U.S.C. 154(b) by 28 days.

(21) Appl. No.: 18/568,733

(22) PCT Filed: Jun. 23, 2022

(86) PCT No.: PCT/EP2022/067238
§ 371 (c)(1),
(2) Date: Dec. 8, 2023

(87) PCT Pub. No.: WO2022/268984
PCT Pub. Date: Dec. 29, 2022

(65) Prior Publication Data

US 2024/0268570 A1 Aug. 15, 2024

(30) Foreign Application Priority Data

Jun. 23, 2021 (CN) ..... 202110697032.1

(51) Int. Cl.
*A47D 9/00* (2006.01)

(52) U.S. Cl.
CPC ..... *A47D 9/005* (2013.01)

(58) Field of Classification Search
CPC ..... A47D 9/00; A47D 9/005; A47D 9/008; A47D 9/012; A47D 13/06; A47D 13/061; A47D 13/063; A47D 13/065
See application file for complete search history.

(56) References Cited

U.S. PATENT DOCUMENTS 5,381,570 A 1/1995 Cheng
9,675,182 B2 * 6/2017 Longenecker ..... A47D 9/016
(Continued)

FOREIGN PATENT DOCUMENTS

CN 201664121 U * 12/2010 ..... A47D 13/063
CN 102068158 A * 5/2011 ..... A47D 13/063
(Continued)

OTHER PUBLICATIONS

Chinese Application No. 2021106970321; First Office Action dated Jul. 31, 2024; 22 pages.
(Continued)

*Primary Examiner* — David E Sosnowski
(74) *Attorney, Agent, or Firm* — CANTOR COLBURN LLP

(57) ABSTRACT

The present disclosure provides a baby bed including a frame body, a locking mechanism and an unlocking mechanism. The frame body includes an upper frame, a lower frame and a side rod, the upper frame includes a first transverse portion, a first longitudinal portion and a first pivoting portion, the first longitudinal portion is pivotally connected to the first transverse portion through the first pivoting portion and includes a first pipe section and a second pipe section; the lower frame includes a second transverse portion, a second longitudinal portion and a second pivoting portion, the second longitudinal portion is pivotally connected to the second transverse portion through the second pivoting portion and includes a third pipe section and a fourth pipe section, which are pivotally connected with each other; the side rod is connected to the first pivoting portion and the second pivoting portion.

26 Claims, 24 Drawing Sheets

(56) References Cited

U.S. PATENT DOCUMENTS

| | | | | |
|---|---|---|---|---|
| 10,463,170 | B2 * | 11/2019 | Lange | A47D 13/063 |
| 10,966,544 | B2 * | 4/2021 | Horst | F16B 12/56 |
| 11,864,667 | B1 * | 1/2024 | Zhang | A47D 9/005 |
| 2003/0030250 | A1 | 2/2003 | Suga et al. | |
| 2007/0017025 | A1 * | 1/2007 | Myer | A47D 7/002 5/99.1 |
| 2008/0189854 | A1 * | 8/2008 | Thorne | A47D 13/061 5/99.1 |
| 2014/0047639 | A1 | 2/2014 | Cheng | |
| 2017/0360218 | A1 | 12/2017 | Dziak et al. | |
| 2019/0142183 | A1 | 5/2019 | Mountz | |

FOREIGN PATENT DOCUMENTS

| | | | | |
|---|---|---|---|---|
| CN | 102101491 | A | | 6/2011 |
| CN | 201847247 | U | * | 6/2011 |
| CN | 104323625 | B | | 4/2017 |
| CN | 107374169 | A | | 11/2017 |
| CN | 109077533 | A | | 12/2018 |
| CN | 208573313 | U | | 3/2019 |
| DE | 102018219509 | A1 | | 5/2019 |
| EP | 3207827 | A1 | | 8/2017 |
| JP | S6015324 | B2 | | 4/1985 |
| JP | H0718659 | U | | 4/1995 |
| JP | H1043244 | A | | 2/1998 |
| JP | 2003054413 | A | | 2/2003 |
| JP | 2024521524 | A | | 5/2024 |
| TW | 391217 | U | | 5/2000 |
| TW | M345539 | U | | 12/2008 |

OTHER PUBLICATIONS

Japanese Application No. 2023-578154; Notice of Reasons for Refusal dated Oct. 8, 2024; 8 pages.

Chinese Application No. 2021106970321; Second Office Action w English Translation dated Mar. 31, 2025; pp. 1-15.

International Search Report for International Application No. PCT/EP2022/067238; International Filing Date: Jun. 23, 2022; Date of Mailing: Sep. 19, 2022; 4 pages.

Taiwanese Application No. 111123503; Office Action dated Dec. 15, 2022; 7 pages.

Written Opinion for International Application No. PCT/EP2022/067238; International Filing Date: Jun. 23, 2022; Date of Mailing: Sep. 19, 2022; 5 pages.

EP Communication; Extended European Search Report; Application No. 25200238.1-1015/4635374; Date Mailed: Oct. 23, 2025; pp. 1-10.

Communication Pursuant to Article 94(3) EPC; App No. 25200238.1; Date Mailed: Sep. 8, 2026; pp. 1-7.

JP Office Action with English Translation; Appl No. 2025-094569; Date Mailed: Sep. 1, 2026; pp. 1-12.

JP Search Report with English translation; Appl No. 2025-094569; Date Mailed: Aug.24, 2026; pp. 1-39.

* cited by examiner

BABY BED

CROSS-REFERENCE TO RELATED APPLICATIONS

This application is a 371 U.S. National Phase of International Patent Application No. PCT/EP2022/067238, filed on Jun. 23, 2022, which is based on and claims priority to Chinese Application No. 202110697032.1, filed on Jun. 23, 2021, which is incorporated herein by reference in their entirety.

TECHNICAL FIELD

The present disclosure relates to the technical field of baby products, and in particular to a baby bed which may be easily folded and retracted.

BACKGROUND

A baby bed is a fairly conventional baby related product, which is suitable for a baby to lie on and provides a comfortable sleeping environment. Generally, the baby bed includes a bed body for carrying the baby, a frame for supporting the bed body, a cloth cover laid on the frame and the like, wherein the frame includes an upper frame enclosing a range for movement or lying of the baby, stands supported on the ground, and side rods connecting the upper frame and the stands. When the baby bed is used by a baby, the upper frame, the side rods and the stands are locked relative to each other, i.e., in a locking state, so as to ensure that the whole baby bed will not collapse due to the movement of the baby, such as turning over or rolling, or external disturbance.

However, when the baby finishes using the baby bed, a user needs to unlock joints one by one which are locked in the above-mentioned locking state, so that the upper frame, the side rods and the stands may be changed into a state that they are movable to each other, and then the baby bed may be folded and retracted, which is cumbersome and time-consuming. In addition, when a parent takes the baby out of the baby bed with one hand, the frame cannot be folded and retracted by one hand, so that the parent has to place the baby somewhere else and then fold the baby bed, thus causing a decreased convenience of using the baby bed.

SUMMARY

The present disclosure provides a baby bed including a frame body, a locking mechanism and an unlocking mechanism. The frame body includes an upper frame, a lower frame and a side rods, wherein the upper frame includes a first transverse portion, a first longitudinal portions and a first pivoting portion, the first longitudinal portion is pivotally connected to the first transverse portion through the first pivoting portion and includes a first pipe section and a second pipe section: the lower frame includes a second transverse portion, a second longitudinal portion and a second pivoting portion, wherein the second longitudinal portion is pivotally connected to the second transverse portion through the second pivoting portion and includes a third pipe section and a fourth pipe section, and the third pipe section and the fourth pipe section are pivotally connected with each other: the side rod is connected to the first pivoting portion and the second pivoting portion. The locking mechanism is connected between the first pipe section and the second pipe section. The first pipe section and the second pipe section are fixed relative to the locking mechanism when the locking mechanism is in a locking state; and the first pipe section and the second pipe section are rotatable relative to the locking mechanism when the locking mechanism is in an unlocking state. The unlocking mechanism is arranged on the first transverse portion and includes an operating element and a driving element, and the operating element is connected to the locking mechanism through the driving element.

Preferably, the locking mechanism includes a locking housing, a limit element and a connecting element. The limit element is fixed relative to the locking housing, and the connecting element is slidably disposed on the limit element and selectively clamped to one of the first pipe section and the second pipe section.

Preferably, another one of the first pipe section and the second pipe section includes an actuating element, a positioning portion and a reset resilient element. The driving element is connected to the operating element and the actuating element, and the reset resilient element is connected between an end of the actuating element and the positioning portion.

Preferably, the locking mechanism further includes a linkage resilient element, and the linkage resilient element is arranged between another end of the actuating element and the connecting element.

Preferably, the first transverse portion includes a pipe body, and an operating hole is formed on the pipe body. The unlocking mechanism further includes an unlocking housing and a protective element. The unlocking housing is provided with an opening and an accommodating hole, and the unlocking housing is sleeved on the pipe body. The protective element penetrates through the operating hole and a part of the protective element is exposed through the opening. The protective element includes a blocking portion, and the operating element penetrates through the accommodating hole and selectively abuts against the blocking portion.

Preferably, the unlocking mechanism further includes a protective resilient element, the unlocking housing further includes a supporting portion, and the protective resilient element is arranged between the protective element and the supporting portion.

Preferably, the supporting portion extends in an extending direction of the first transverse portion and is fixed relative to the pipe body, the protective resilient element is sleeved on the supporting portion, and the protective element is fixed relative to the protective resilient element.

Preferably, the unlocking mechanism further includes an unlocking housing and at least one positioning element, at least one limit portion is formed on the unlocking housing, at least one sliding groove is formed on the operating element, the positioning element is slidably disposed in the limit portion and the sliding groove, and the driving element is connected to the positioning element.

Preferably, a part of the driving element is embedded in the first transverse portion, and an extending direction of the sliding groove is inclined relative to the extending direction of the first transverse portion.

Preferably, the lower frame further includes a third pivoting portion and a bottom pipe. The third pivoting portion is connected between the third pipe section and the fourth pipe section and includes a pivot limit portion: the bottom pipe is arranged in parallel with the second transverse portion, and an end of the bottom pipe is connected to the third pivoting portion.

Preferably, the baby bed further includes a lower frame locking mechanism. The lower frame locking mechanism includes a third pivoting portion, a locking element and a lower frame operating element. The third pivoting portion includes a third pipe housing and a fourth pipe housing, wherein the third pipe housing is fixed relative to the third pipe section, the fourth pipe housing is fixed relative to the fourth pipe section, the third pipe housing and the fourth pipe housing jointly define a pivot cavity, and at least one of the third pipe housing and the fourth pipe housing is formed with an engaging feature in the pivot cavity: the locking element is slidably disposed in the pivot cavity and includes an engaging portion and an extending portion, the engaging portion is selectively engaged with the engaging feature, and the extending portion is connected to the engaging portion: the lower frame operating element is fixed relative to the extending portion.

Preferably, a plurality of second longitudinal portions and a plurality of lower frame locking mechanisms are provided, and the baby bed further includes a lower frame synchronizing mechanism. The lower frame synchronizing mechanism includes a synchronizing element and a plurality of linkage elements, the synchronizing element is pivotably connected to the plurality of linkage elements, and the linkage elements are fixedly disposed on locking elements of the lower frame locking mechanisms, respectively.

Preferably, the lower frame further includes a bottom pipe which is connected to the third pivoting portion and arranged in parallel with the second transverse portion. At least a part of the linkage elements and the synchronizing element are arranged in the bottom pipe, and the lower frame operating element is sleeved on the bottom pipe.

Preferably, the bottom pipe is formed with a plurality of synchronous limit grooves, and the lower frame synchronizing mechanism further includes a plurality of synchronous locking elements which penetrate through the corresponding locking elements, lower frame operating element, linkage elements and synchronous limit grooves.

Preferably, the lower frame locking mechanism further includes a pivot limit element which is formed with a protruding portion, and one of the third pipe housing and the fourth pipe housing is formed with a pivot limit groove, and the protruding portion is embedded in the pivot limit groove.

Preferably, the baby bed further includes a lower frame locking mechanism. The lower frame locking mechanism includes a third pivoting portion and a lower frame operating element, wherein the third pivoting portion includes a third pipe housing and a fourth pipe housing, the third pipe housing is fixed relative to the third pipe section, and the fourth pipe housing is fixed relative to the fourth pipe section. The third pipe housing and the fourth pipe housing jointly define a pivot cavity; and at least one of the third pipe housing and the fourth pipe housing is formed with an engaging feature in the pivot cavity: the lower frame operating element is pivotably connected to the third pivoting portion, and a part of the lower frame operating element is exposed relative to the third pivoting portion, the lower frame operating element includes an engaging portion, and the engaging portion and the engaging feature are selectively clamped with each other.

Preferably; the engaging feature is a long groove extending in a radial direction of at least one of the third pipe housing and the fourth pipe housing. At least one of the third pipe housing and the fourth pipe housing is also formed with a pivot groove in the pivot cavity; the pivot groove is arranged in a circumferential direction of at least one of the third pipe housing and the fourth pipe housing and is communicated with the long groove, and the engaging portion is slidably disposed in the long groove and the pivot groove.

Preferably, the lower frame locking mechanism further includes a lower frame resilient element, and the lower frame resilient element is arranged between the lower frame operating element and the third pivoting portion in an extending direction of the engaging feature.

Preferably, a plurality of second longitudinal portions and a plurality of lower frame locking mechanisms are provided, and the baby bed further includes a plurality of lower frame synchronizing mechanisms. Each of the lower frame synchronizing mechanisms corresponds to a corresponding lower frame locking mechanism and includes a linkage element, and the linkage element is pivotably arranged in the pivot cavity and clamped to the lower frame operating element. The lower frame further includes a bottom pipe, and the bottom pipe is connected to the third pivoting portion of each of the lower frame locking mechanisms and fixed relative to the linkage element of each of the lower frame synchronizing mechanisms.

Preferably, the baby bed further includes a lower frame locking mechanism. The lower frame locking mechanism includes a third pivoting portion and a lower frame operating portion. The third pivoting portion includes a third pipe housing and a fourth pipe housing, wherein the third pipe housing is fixed relative to the third pipe section, the fourth pipe housing is fixed relative to the fourth pipe section, the third pipe housing and the fourth pipe housing jointly define a pivot cavity, and at least one of the third pipe housing and the fourth pipe housing is formed with an engaging feature in the pivot cavity. The lower frame operating portion includes a clamping element, a pivot element and a plurality of lower frame operating elements, wherein the clamping element is slidably disposed in the pivot cavity and is selectively clamped with the engaging features, the pivot element is pivotably connected to the clamping element, and the lower frame operating element is connected to the pivot element and at least a part of the lower frame operating element is exposed relative to the third pivoting portion.

Preferably, a plurality of third pivoting portions are provided, the lower frame further includes a bottom pipe connected between the third pivoting portions, the pivot element penetrates through the bottom pipe, and an end of the pivot element is arranged in the pivot cavity.

Preferably, the lower frame operating portion further includes a plurality of linkage elements sleeved on the bottom pipe and fixed relative to the pivot element, and the lower frame operating element is arranged on the linkage element.

Preferably, the lower frame operating portion further includes a lower frame resilient element, and the resilient element is arranged between the clamping element and the third pivoting portion.

Preferably, a length of the first pipe section is equal to a length of the second pipe section, and a length of the third pipe section is equal to a length of the fourth pipe section.

Preferably, a length of the first transverse portion is smaller than a length of the first longitudinal portion, and a length of the second transverse portion is smaller than a length of the second longitudinal portion.

BRIEF DESCRIPTION OF THE DRAWINGS

The present disclosure will be more apparent from the following description in combination with the accompanying drawings, which are used to explain the embodiments of the present disclosure.

LIST OF REFERENCE NUMBERS

Baby Bed 1, 1", 1""
Frame Body 10
Upper Frame 100
First Transverse Portion 110, 110', 110"
Pipe Body 112, 112', 112"
Positioning Column 112*a*
Positioning Groove 112*b*
First Longitudinal Portion 120
First Pipe Section 122
Actuating Element 122*a*
Positioning Portion 122*b*
Reset Resilient Element 122*c*
Second Pipe Section 124
First Pivoting Portion 130
Upper Sleeve 132
Lower Sleeve 134
Lower Frame 200, 200"
Second Transverse Portion 210
Second Longitudinal Portion 220
Third Pipe Section 222
Fourth Pipe Section 224
Second Pivoting Portion 230
Upright Portion 232
Third Pivoting Portion 240, 240"
Auxiliary Upright Portion 242
Pivot Limit Portion 244
Third Pipe Housing 246, 246'"
Engaging Feature 246*a*
Fourth Pipe Housing 248, 248'"
Engaging Feature 248*a*
Pivot Groove 248*b*
Bottom Pipe 250, 250"
Side Rod 300
Locking Mechanism 20
Locking Housing 21
Limit Element 22,
Connecting Element 23
Linkage Resilient Element 24
Unlocking Mechanism 30, 30', 30"
Unlocking Housing 31, 31', 31"
Limit Portion 31*a*
Supporting Portion 31*b*, 31*b"*
Operating Element 32
Driving Element 33
Positioning Element 34
Protective Element 35, 35"
Blocking Portion 35*a*, 35*a"*
Protective Resilient Element 36

Bearing Element 40
Lower Frame Locking Mechanism 50, 50''', 50''''
Locking Element 51
Clamping Element 51'
Engaging Portion 51*a*
Extending Portion 51*b*
Lower frame operating element 52, 52''', 52''''
Engaging Portion 52*a*
Abutting Portion 52*b*
Clamping Portion 52*c*
Lower Frame Resilient Element 53
Synchronous Locking Element 54
Pivot Limit Element 55
Pivot Element 55'
Protruding Portion 55*a*
Lower Frame Synchronizing Mechanism 60
Synchronizing Element 61
Linkage Element 62, 62''', 62''''
Protruding Column 62*a*
Accommodating Hole A
Pivot Cavity C
Transverse Direction D
Pivot Groove G
Operating Hole H
Opening O
Pivot Limit Groove R
Sliding Groove S
Synchronous Limit Groove T

DETAILED DESCRIPTION

Embodiments of the present disclosure will now be described with reference to the accompanying drawings, in which like reference numbers represent like components.

An objective of at least one of the embodiments of the present disclosure is to provide a baby bed that is easily foldable and retractable.

Figure 1:
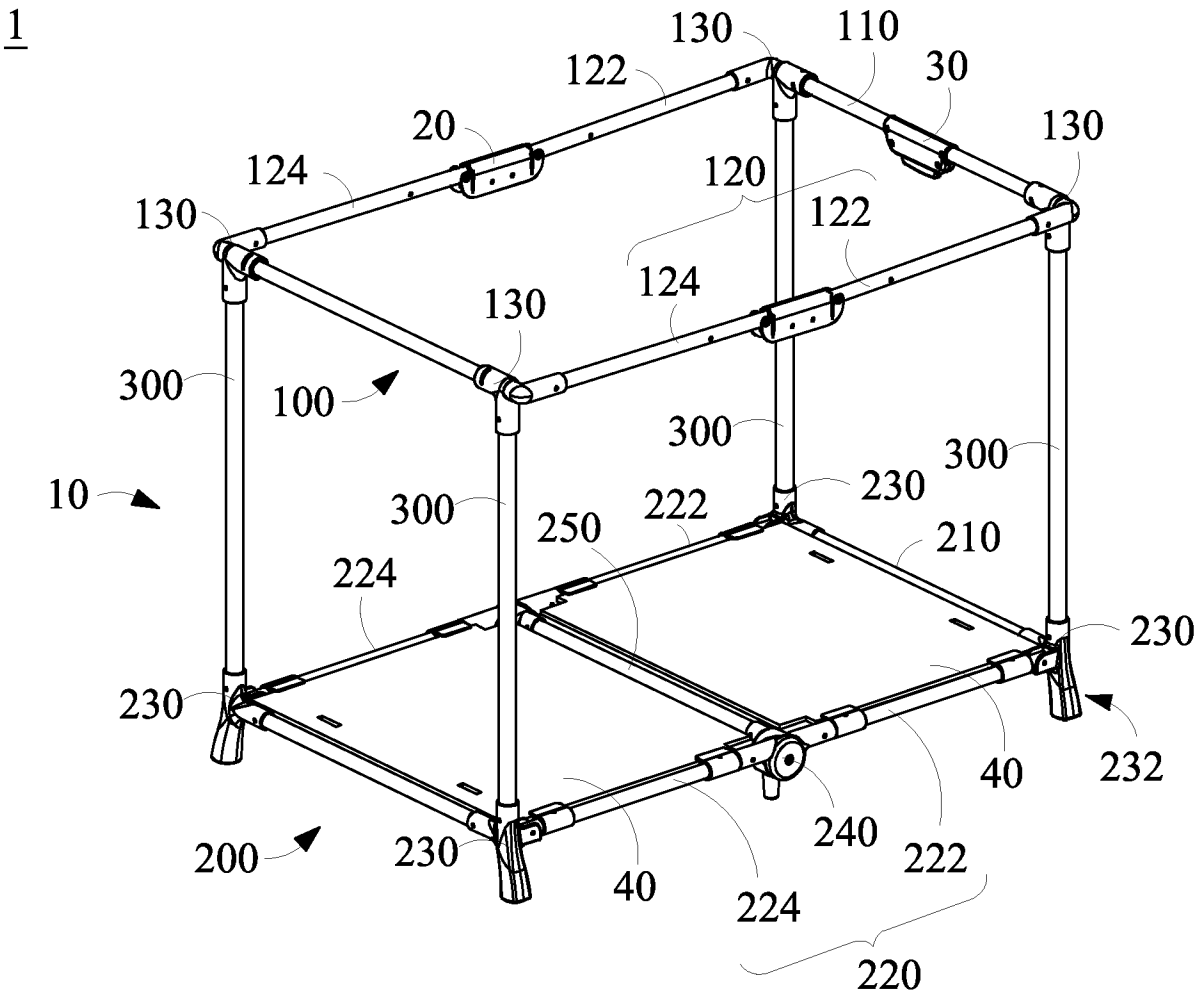
FIG. 1 is a schematic perspective view of a baby bed according to a first embodiment of the present disclosure.
Figure 10:
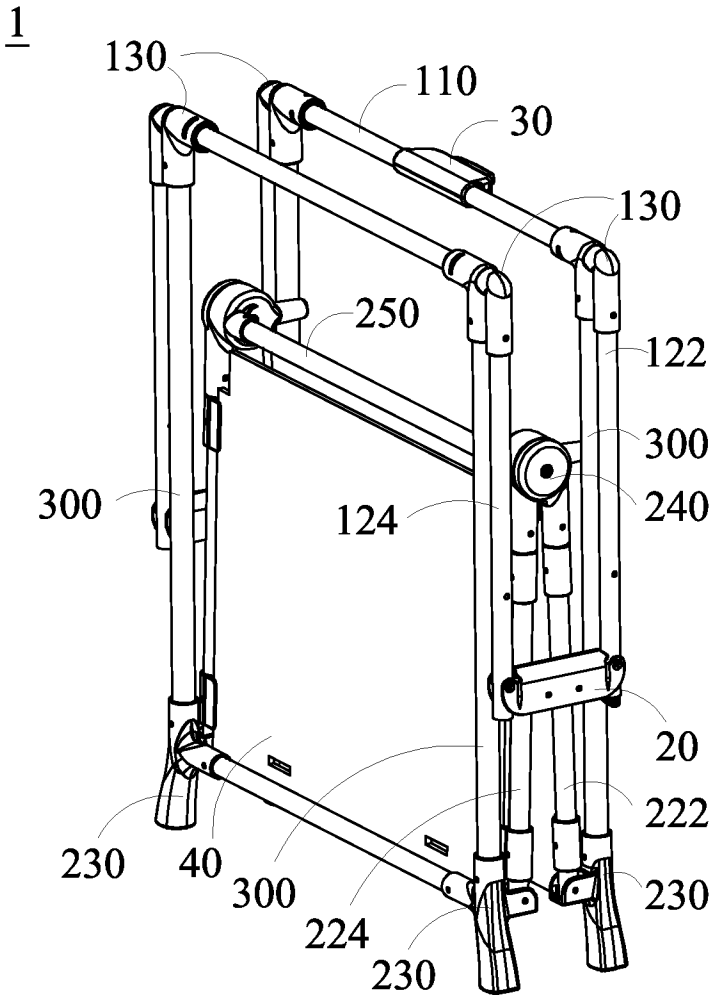
FIG. 10 is a schematic perspective view of the baby bed of FIG. 1 after being completely folded and retracted.

Referring to FIG. 1, FIG. 1 is a schematic perspective view of a baby bed according to a first embodiment of the present disclosure. The baby bed 1 of this embodiment is suitable for accommodating a baby. When the baby bed 1 is intended to be used by a user, the baby bed 1 may be unfolded to an unfolded state as shown in FIG. 1; and when the user finishes using the baby bed 1, the baby bed 1 may be folded and retracted to a retracted state as shown in FIG. 10, thereby saving an indoor space of the user that is occupied by the baby bed 1 when it is not used. In addition, in order to prevent the baby bed 1 from accidentally being folded due to disturbance of an external force or accidental collision by the user during use and thereby accidentally injuring the baby, in this embodiment, the baby bed 1 also has a locking function for locking in the unfolded state and an unlocking function for releasing the locking state.

In detail, the baby bed 1 includes a frame body 10, a locking mechanism 20 and an unlocking mechanism 30. The frame body 10 includes an upper frame 100, a lower frame 200 and side rods 300, wherein the upper frame 100 may be regarded as an armrest of a baby bed frame and includes a first transverse portion 110, at least one first longitudinal portion 120 and at least one first pivoting portion 130. In this embodiment, two first longitudinal portions 120 are provided opposite to each other, and these first longitudinal portions 120 are pivotally connected to both ends of the first transverse portion 110 through the first pivoting portions 130, respectively. The lower frame 200 may be regarded as a base of the baby bed frame, and includes a second transverse portion 210, at least one second longitudinal portion 220 and at least one second pivoting portion 230. In this embodiment, two second longitudinal portions 220 are provided, and are pivotally connected to both ends of the second transverse portion 210 through the second pivoting portions 230 on both sides, respectively. In addition, each of the at least one second pivoting portion 230 has an upright portion 232, which may be used as a support leg of the baby bed 1 and keep a proper distance between the lower frame 200 and the ground. The side rod 300 is connected to the first pivoting portion 130 and the second pivoting portion 230 so that the upper frame 100 and the lower frame 200 face towards each other. The locking mechanism 20 is arranged on the first longitudinal portion 120, and the unlocking mechanism 30 is arranged on the first transverse portion 110.

As shown in FIG. 1, the upper frame 100 and the lower frame 200 each constitutes a rectangle, and a length of the first transverse portion 110 is smaller than a length of the first longitudinal portion 120, and a length of the second transverse portion 210 is smaller than a length of the second longitudinal portion 220. In other words, the unlocking mechanism 30 of the baby bed 1 is disposed on a short side of the armrest of the bed frame, which is a long side of the folded bed frame, thereby shortening an occupied length of the baby bed 1 in an indoor space after being folded.

On the other hand, the first longitudinal portion 120 includes a first pipe section 122 and a second pipe section 124, and the locking mechanism 20 is connected between the first pipe section 122 and the second pipe section 124. Specifically, the locking mechanism 20 of this embodiment may be switched between a locking state and an unlocking state. When the locking mechanism 20 is in the locking state, the first pipe section 122 and the second pipe section 124 are fixed relative to the locking mechanism 20; and when the locking mechanism 20 is in the unlocking state, the first pipe section 122 and the second pipe section 124 may rotate relative to the locking mechanism 20. The action mechanism of this part will be described in more detail later.

Corresponding to the first longitudinal portion 120, the second longitudinal portion 220 includes a third pipe section 222 and a fourth pipe section 224, and the third pipe section 222 and the fourth pipe section 224 are pivotally connected to each other. Preferably, the lower frame 200 further includes at least one third pivoting portion 240 and a bottom pipe 250, wherein the third pivoting portion 240 is connected between the third pipe section 222 and the fourth pipe section 224, the bottom pipe 250 is arranged in parallel with the second transverse portion 210, and an end of the bottom pipe 250 is connected to the third pivoting portion 240. In this embodiment, a length of the first pipe section 122 is substantially equal to a length of the second pipe section 124, and a length of the third pipe section 222 is substantially equal to a length of the fourth pipe section 224. In other words, the baby bed 1 is semi-folded from the unfolded state shown in FIG. 1 to the retracted state shown in FIG. 10. The baby bed 1 having this design is not only symmetrical and beautiful at both sides thereof, but also has a stable center of gravity during folding, which is beneficial for the user to operate and fold the baby bed with one hand.

Preferably; the baby bed 1 further includes at least one bearing element 40, wherein the bearing element 40 is, for example, a flexible lining, and is arranged between the second transverse portion 210, the second longitudinal portion 220, and the bottom pipe 250 to bear the baby for lying down. When the baby bed 1 needs to be retracted, the frame body 10 may be folded directly without disassembling the bearing element 40, which is simple and convenient. In addition to the flexible lining used to bear the baby, the bearing element 40 may also be made of a plate-like material with high rigidity to improve a supporting strength of a bottom of the baby bed 1, and a soft and thick cushion is laid on it to make the baby more comfortable when lying down. However, the present disclosure is not limited to the above embodiments.

Figure 2:
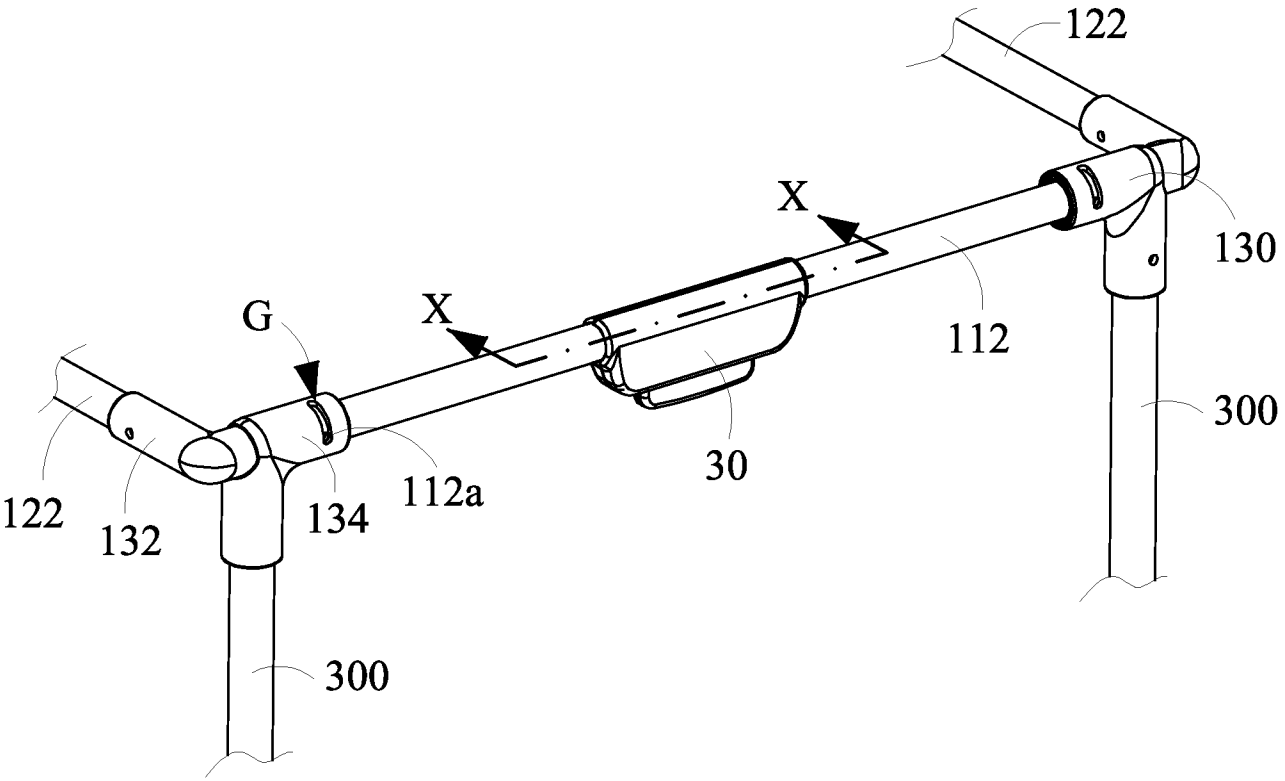
FIG. 2 is a partially enlarged schematic view of an upper frame in FIG. 1.

Referring to FIG. 2, FIG. 2 is a partially enlarged schematic view of an upper frame in FIG. 1. As shown, the first pivoting portion 130 includes an upper sleeve 132 and a lower sleeve 134, wherein the upper sleeve 132 is sleeved on the first transverse portion 110 and the first pipe section 122 of the first longitudinal portion 120 at each of both sides of the baby bed 1, and the lower sleeve 134 is sleeved on the first transverse portion 110, the upper sleeve 132 and the side rod 300. In other words, the first pivoting portion 130 limits the first longitudinal portion 120 to be rotatable only around an axis of the first longitudinal portion 120. Preferably, the first transverse portion 110 includes a tube body 112 on which a positioning column 112*a* is formed, a pivot groove G is formed on the lower sleeve 134, and the positioning column 112*a* is slidably disposed in the pivot groove G. When the baby bed 1 is in the unfolded state as shown in FIG. 2, the positioning column 112*a* is located at a lower end of the pivot groove G (i.e., an end close to the side rod 300), and when the baby bed 1 is folded to the retracted state as shown in FIG. 10, the positioning column 112*a* will rotate to an upper end of the pivot groove G (i.e., an end away from the side rod 300) along with the rotation of the first transverse portion 110. This design can not only limit a rotating direction of the first longitudinal portion 120, but also establish a rotating stroke of the first pipe section 122 through the positioning column 112*a* and the pivot groove G, preventing the baby bed 1 from being excessively unfolded or folded.

Figure 3:
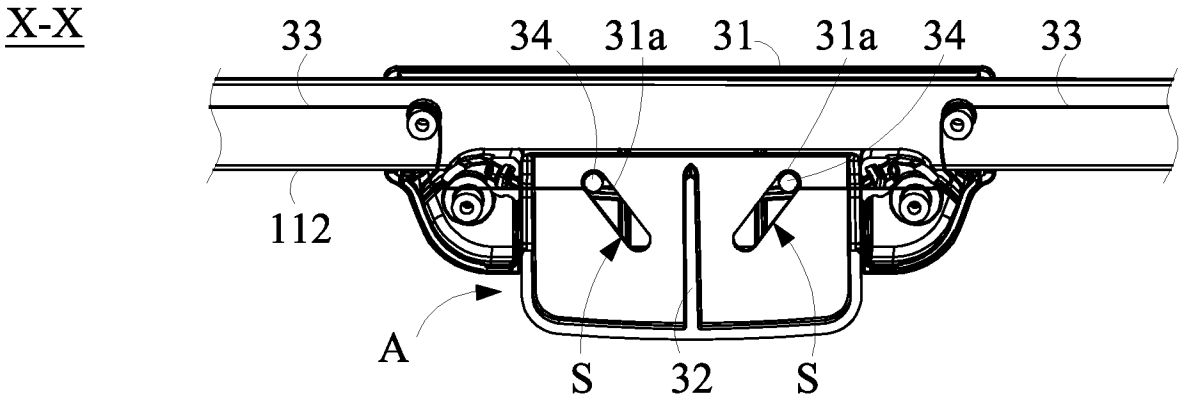
FIG. 3 is a schematic sectional view of an unlocking mechanism in FIG. 2 taken along the X-X section in a locking state.
Figure 4:
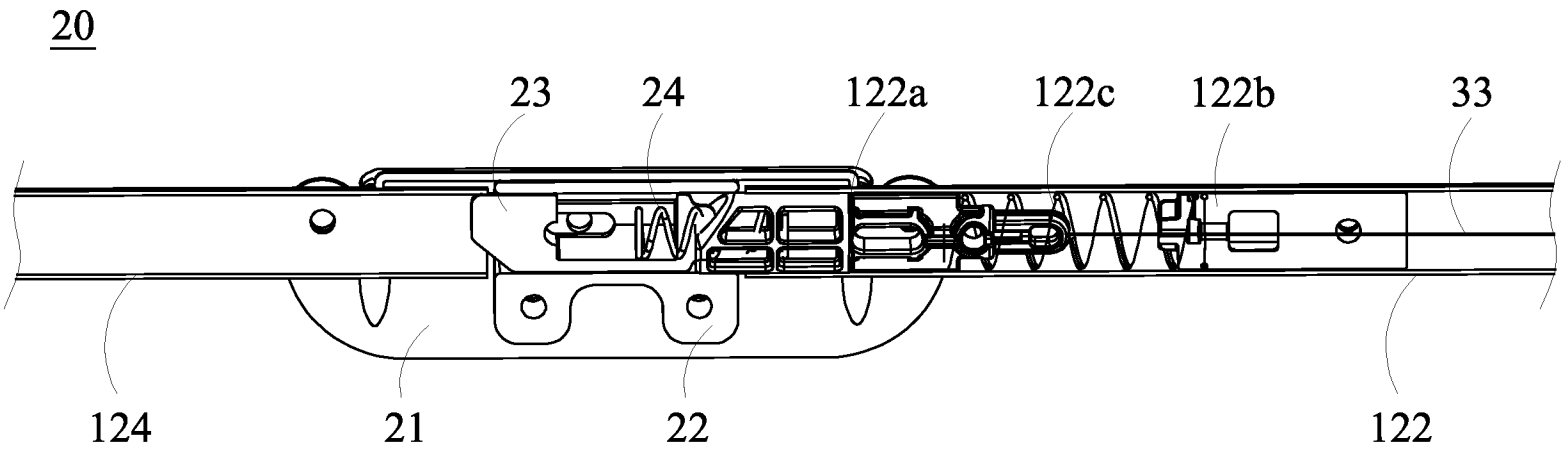
FIG. 4 is a schematic sectional view of a locking mechanism in FIG. 1 in the locking state.
Figure 5:
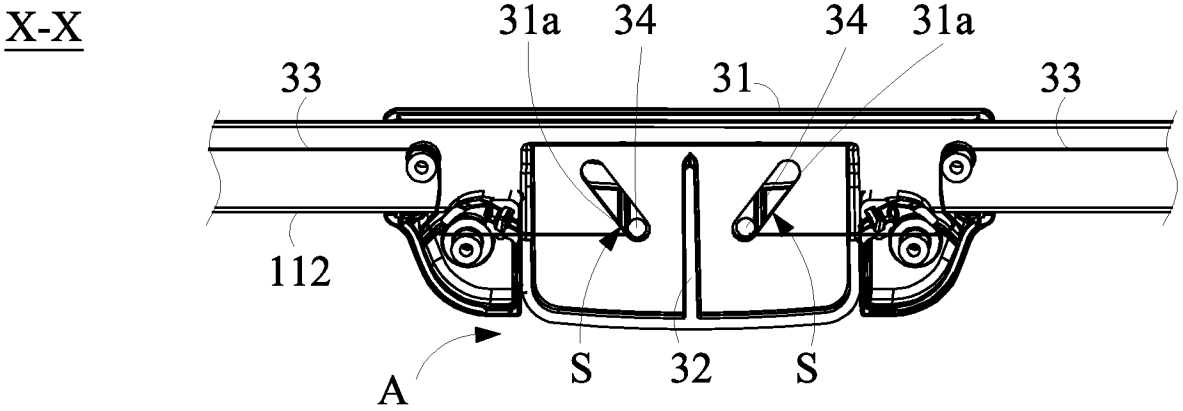
FIG. 5 is a schematic sectional view of the unlocking mechanism in FIG. 2 taken along the X-X section in an unlocking state.
Figure 6:
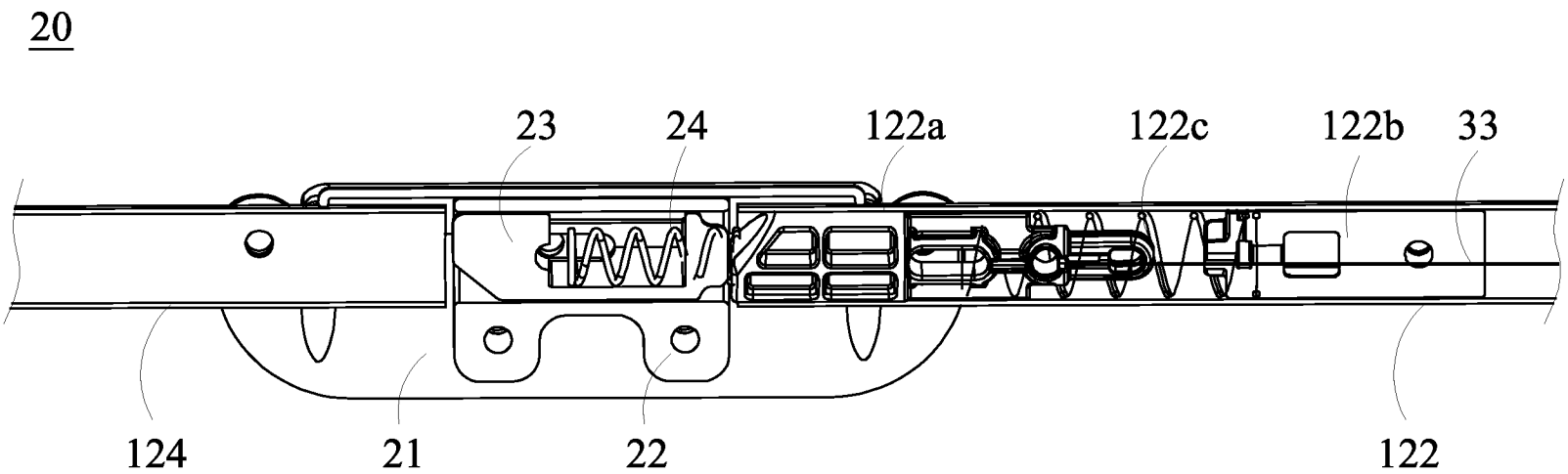
FIG. 6 is a schematic sectional view of the locking mechanism in FIG. 1 in the unlocking state.
Figure 7:
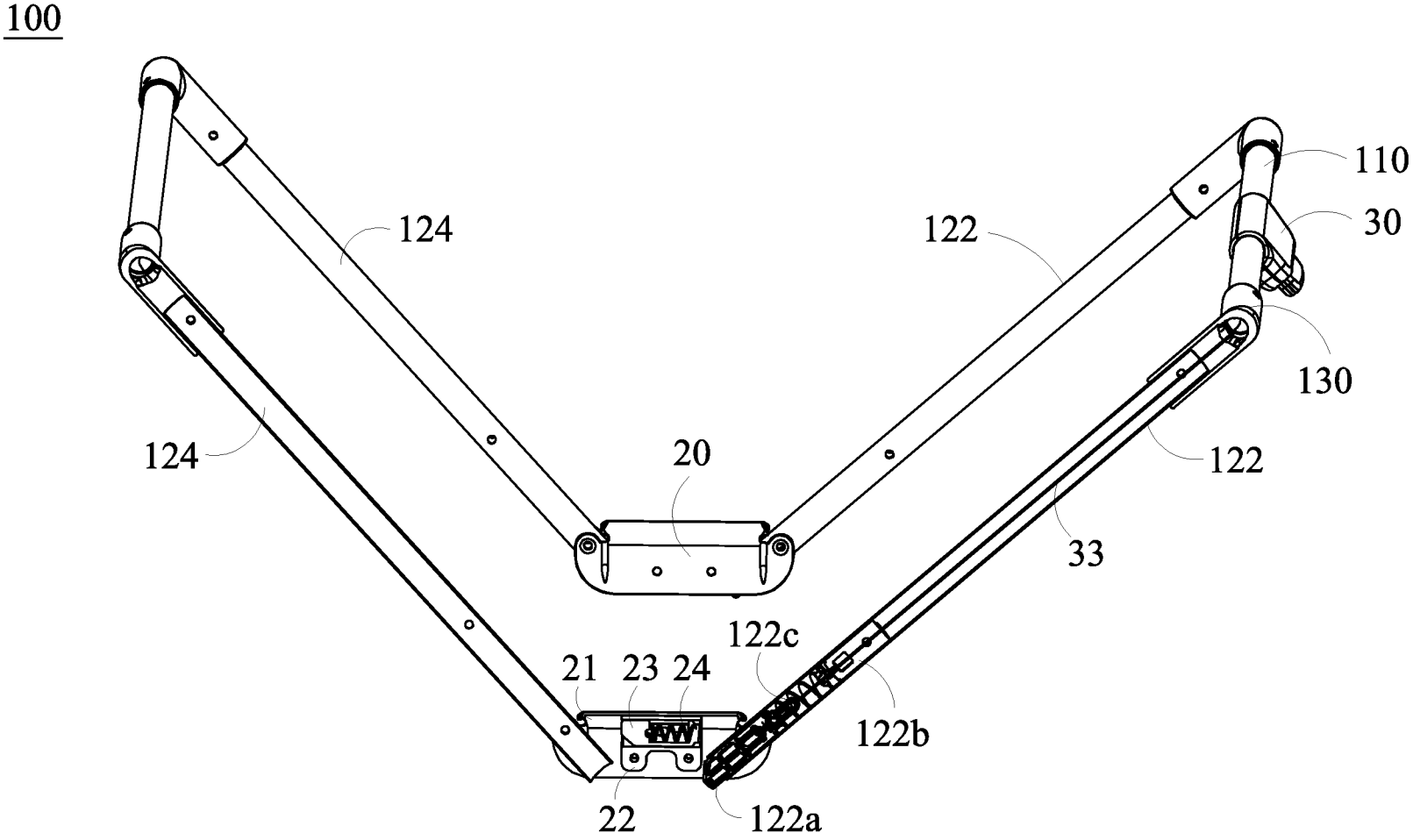
FIG. 7 is a schematic view when the upper frame in FIG. 1 is unlocked, folded and retracted.
Figure 8:
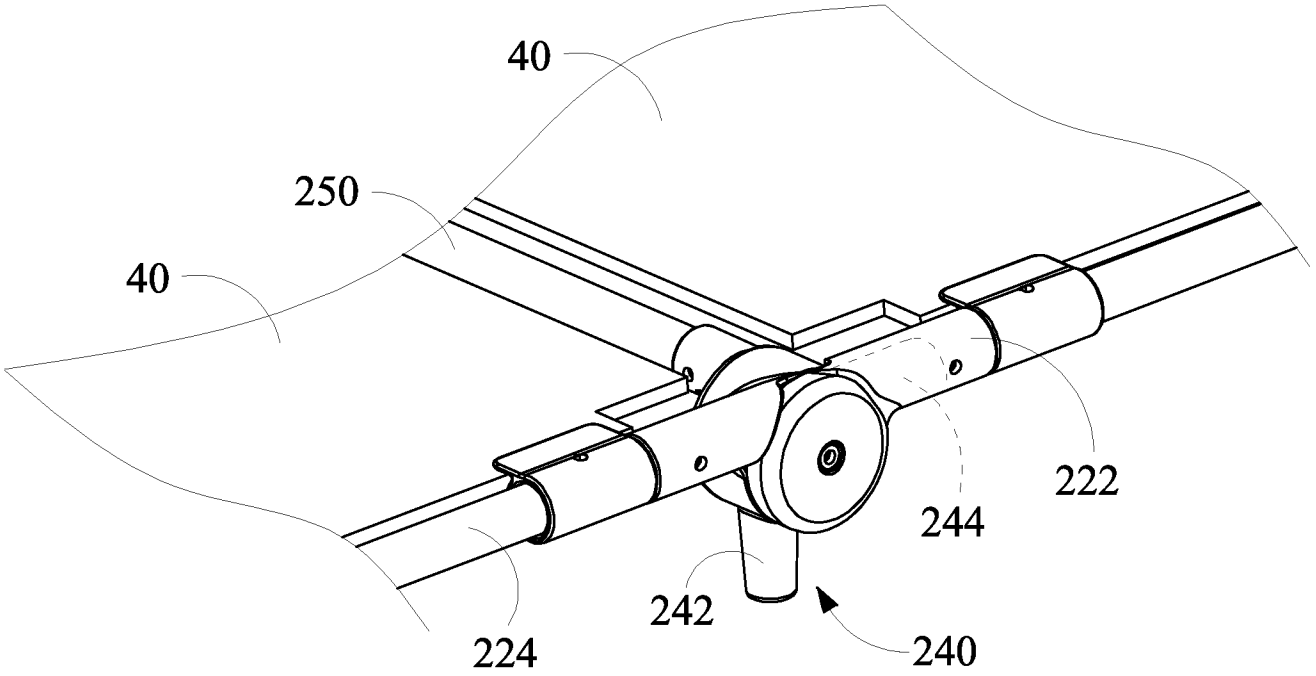
FIG. 8 is a partially enlarged schematic view of a lower frame in FIG. 1.
Figure 9:
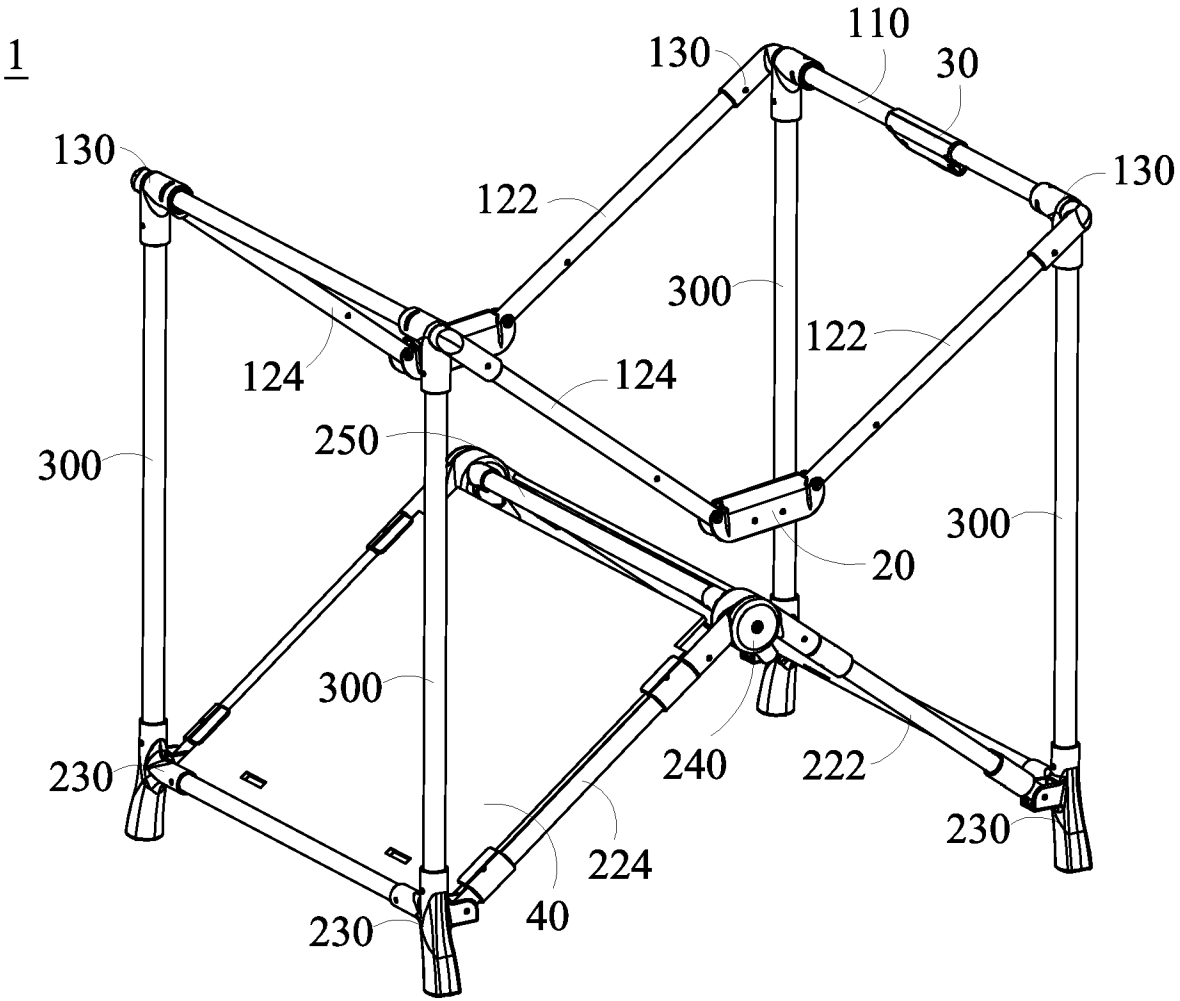
FIG. 9 is a schematic perspective view of the baby bed of FIG. 1 during folding and retracting.

The locking principle and unlocking principle of the baby bed 1 of this embodiment will be described in detail below: Referring to FIGS. 3 to 10, FIGS. 3 to 6 are sectional views of the unlocking mechanism in FIG. 2 and the unlocking mechanism in FIG. 1 in locking and unlocking states, respectively: FIG. 7 is a schematic view of the upper frame in FIG. 1 when it is unlocked, folded and retracted: FIG. 8 is a partially enlarged schematic view of the lower frame in FIG. 1; and FIGS. 9 and 10 are schematic perspective views of the baby bed during folding and retracting and when completely folded and retracted, respectively. As shown in FIGS. 3 and 4, the locking mechanism 20 includes a locking housing 21, a limit element 22 and a connecting element 23, wherein the limit element 22 is tubular and fixed relative to the locking housing 21, and the connecting element 23 is slidably disposed in a hollow part of the limit element 22. In addition, the unlocking mechanism 30 includes an unlocking housing 31, an operating element 32, at least one driving element 33 and at least one positioning element 34, wherein the unlocking housing 31 is formed with at least one limit portion 31*a* and an accommodating hole A, the operating element 32 passes through the accommodating hole A, and at least one sliding groove S is formed on the operating element 32. The positioning element 34 is, for example, a positioning pin and slidably disposed in the limit portion 31*a* and the sliding groove S, while the driving element 33 is, for example, a steel cable, a part of which is embedded in the first transverse portion 110 and connected to the positioning element 34.

On the other hand, the first pipe section 122 includes an actuating element 122*a*, a positioning portion 122*b*, and a reset resilient element 122*c*, wherein the actuating element 122*a* is arranged on an end of the first pipe section 122 connected to the locking mechanism 20, and the driving element 33 is connected to the actuating element 122*a*. The positioning portion 122*b* is, for example, a sheath of the driving element 33 and fixed relative to the first pipe section 122, and the reset resilient element 122*c* is, for example, a linear spring and connected between an end of the actuating element 122*a* close to the first pivoting portion 130 and the positioning portion 122*b*. In other words, the driving element 33 is connected to the operating element 32 and the actuating element 122*a* through the positioning element 34, and the operating element 32 is connected to the locking mechanism 20 through the driving element 33. Preferably, the locking mechanism 20 further includes a linkage resilient element 24, wherein the linkage resilient element 24 is, for example, a spring and is arranged between another end of the actuating element 122*a* (i.e., an end close to the locking mechanism 20) and the connecting element 23.

When the locking mechanism 20 is in the locking state as shown in FIG. 4, and the unlocking mechanism 30 is not yet unlocked as shown in FIG. 3, a right end of the actuating element 122*a* is abutted by the reset resilient element 122*c* to penetrate into the limit element 22 and abut against the linkage resilient element 24, so that the linkage resilient element 24 is deformed and a part of the connecting element 23 is pushed into the second pipe section 124. In other words, when the locking mechanism 20 is in the locking state, the first pipe section 122 is clamped to the limit element 22 through the actuating element 122*a*, and the connecting element 23 is clamped to the second pipe section, so that the first pipe section 122 and the second pipe section 124 are fixed relative to the locking mechanism 20 and cannot rotate freely, ensuring that the baby bed 1 is maintained in the unfolded state.

When the user intends to unlock, fold and retract the baby bed 1, the operating element 32 may be pressed into the accommodating hole A, and at this time the positioning element 34 will be jointly limited by the limit portion 31*a* and the sliding groove S and slide towards a center of the operating element 32. In this embodiment, an extending direction of the sliding groove S is inclined relative to an extending direction of the first transverse portion 110, so that when the positioning element 34 slides towards the center of the operating element 32, it will pull the driving element 33 and drive the actuating element 122*a* to slide towards the positioning portion 122*a* to be disengaged from the limit element 22. At the same time, since the linkage resilient element 24 is no longer abutted by the actuating element 122*a*, the connecting element 23 retracts towards the inside of the locking housing 21 and is no longer clamped to the second pipe section 124, forming the unlocking state as shown in FIGS. 5 and 6. In other words, the connecting element 23 is selectively clamped to the second pipe section 124 by abutment of the linkage resilient element 24. After that, the user may rotate the first pipe section 122 and the second pipe section 124 in a counterclockwise direction and in a clockwise direction in FIG. 7, respectively, and start folding and retracting the baby bed 1.

On the other hand, as shown in FIG. 8, the third pivoting portion 240 includes an auxiliary upright portion 242, which may assist the upright portion 232 to support the frame body 10 at the center of the baby bed 1, and a pivot limit portion 244, which is, for example, a bump disposed at an end of the third pipe section 222 or the fourth pipe section 224 for limiting the third pipe section 222 and the fourth pipe section 224 in one direction. In other words, when the third pipe section 222 and the fourth pipe section 224 are unfolded to be parallel to the ground, the pivot limit portion 244 will be clamped with the third pipe section 222 or the fourth pipe section 224, so that they cannot continue to rotate downwards. On the contrary; when the user starts to fold and retract the baby bed 1, it is only necessary to kick the third pivoting portion 240 upward for a certain distance by the user's foot, so that the third pipe section 222 and the fourth pipe section 224 will no longer be clamped to the pivot limit portion 244 and rotate relative to each other around the bottom pipe 250 as a pivot axis, forming a state shown in FIG. 9. Finally, the user approaches and closes the side rods 300 at both sides towards the middle, so that the baby bed 1 may be completely folded and retracted, forming a state as shown in FIG. 10.

It is worth mentioning, when the baby bed 1 is switched from the retracted state to the unfolded state, the actuating element 122*a* will be subjected to the elastic force of the reset resilient element 122*c* again and automatically penetrate into the limit element 22, and push against the linkage resilient element 24 so as to push and lock the connecting element 23 into the second pipe section 124, which is simple and convenient.

In addition, although in this embodiment the first pipe section 122 is clamped to the limit element 22 by the actuating element 122*a*, and clamped to the second pipe section 124 by the connecting element 23, the present disclosure is not limited thereto. In other possible embodiments, the actuating element 122*a* may be arranged at an end of the second pipe section 124, and clamped to the first pipe section 122 by the connecting element 23 to form the locking state, which can also achieve the same effect.

Furthermore, although in this embodiment the first pipe section 122, the second pipe section 124, the third pipe section 222 and the fourth pipe section 224 are used as components of the first longitudinal portion 120 and the second longitudinal portion 220, and parts of locking assembly and unlocking assembly penetrate into hollow parts of the above-mentioned pipe sections, the present disclosure is not limited to the above embodiment. In other possible embodiments, all the above-mentioned pipe sections may be replaced by solid rod sections, and at the same time, sliding grooves or accommodating grooves, in which the above-mentioned components slide or extend, may be reserved on the rod sections, which can achieve the same effect.

Figure 11:
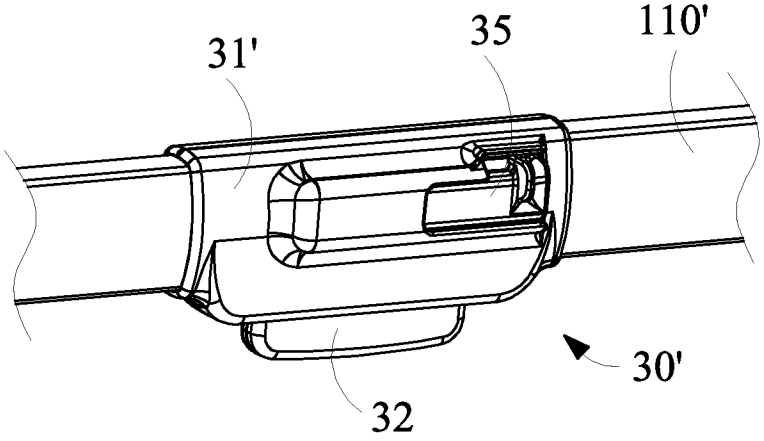
FIG. 11 is a partially enlarged schematic view of an upper frame of a baby bed according to a second embodiment of the present disclosure.

Referring to FIG. 11, FIG. 11 is a partially enlarged schematic view of an upper frame of a baby bed according to a second embodiment of the present disclosure. The baby bed 1 of this embodiment is similar to the baby bed 1 shown in FIG. 1. The main differences between the both are that the unlocking mechanism 30' in FIG. 11 further includes a protective element 35 and that the protective element 35 penetrates through the unlocking housing 31'.

Figure 13:
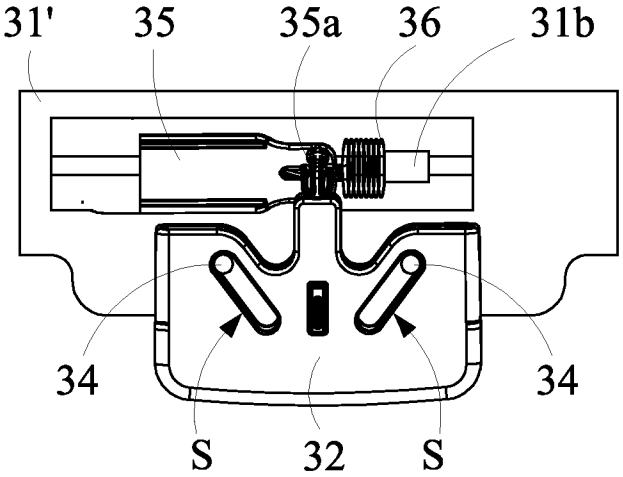
FIG. 13 is a schematic configuration view of some components in FIG. 11.
Figure 12:
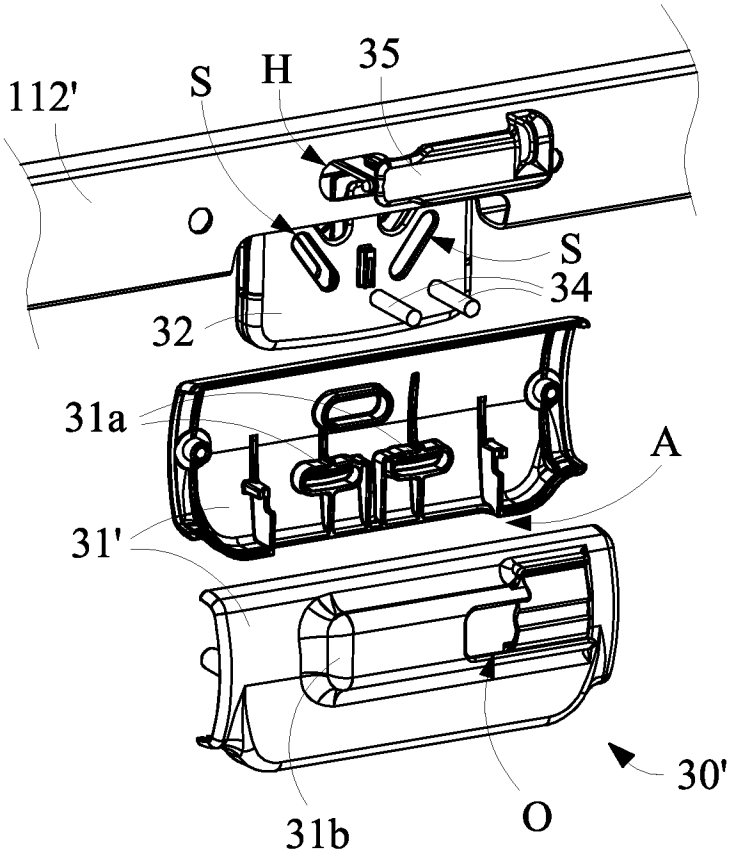
FIG. 12 is an exploded schematic view of components in FIG. 11.

Specifically, in order to prevent the user from accidentally touching the operating element 32 and accidentally folding the baby bed 1 to cause injury to the baby, the unlocking mechanism 30' of this embodiment adds a protecting mechanism to prevent the user from accidentally touching the operating element 32. Together referring to FIGS. 12 and 13, FIG. 12 is an exploded schematic view of components in FIG. 11, and FIG. 13 is a schematic configuration view of some components in FIG. 11. In this embodiment, the pipe body 112' of the first transverse portion 110' is formed with an operating hole H. In addition, the unlocking mechanism 30' also includes a protective resilient element 36, and the unlocking housing 31' is formed with a supporting portion 31*b* and an opening O in addition to the structure of FIGS. 3 and 5, wherein the supporting portion 31*b* is recessed towards the inside of the unlocking housing 31', the protective element 35 penetrates through the operating hole H and has a part exposed through the opening O for the user to access and operate, and the protective resilient element 36 is for example a linear spring, and is arranged between the protective element 35 and the supporting portion 31*b*.

As shown in FIG. 13, the protective element 35 includes a blocking portion 35*a* having a shape corresponding to an upper edge of the operating element 32. When the locking mechanism 20 is in the locking state, since the upper edge of the operating element 32 abuts against the blocking portion 35*a*, the user cannot directly press the operating element 32 into the accommodating hole A, so that the baby bed 1 cannot be folded, thereby ensuring that the baby bed 1 will not be accidentally folded because the user touches the operating element 32 by mistake.

Figure 15:
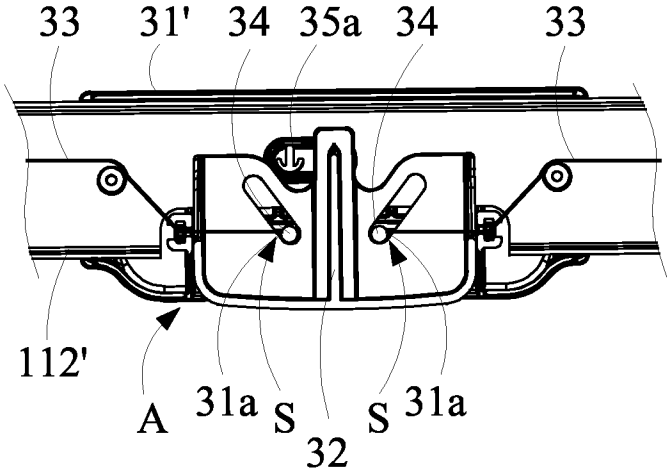
FIG. 15 is a schematic sectional view of the unlocking mechanism in FIG. 11 in an unlocking state.
Figure 14:
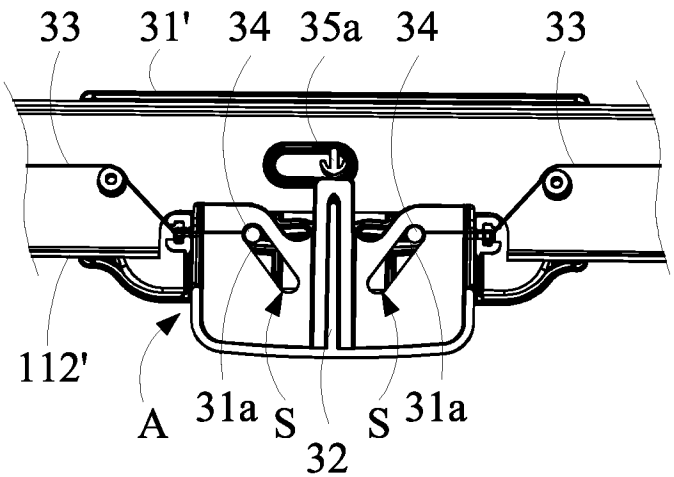
FIG. 14 is a schematic sectional view of an unlocking mechanism in FIG. 11 in a locking state.

Referring to FIGS. 14 and 15, FIG. 14 is a schematic sectional view of an unlocking mechanism in FIG. 11 in a locking state, and FIG. 15 is a schematic sectional view of the unlocking mechanism in FIG. 11 in an unlocking state. If the user intends to retract the baby bed 1, it is only necessary to pull the operating element 35 to the left in FIG. 14 with one hand, so that the blocking portion 35*a* slides to the left and no longer abuts against the upper edge of the operating element 32. At this time, the user may press the operating element 32 into the accommodating hole A with another finger, and perform the above unlocking, folding and retracting processes. When the user's hand leaves the unlocking mechanism 30', the protective element 35 will be pulled by the elastic force of the protective resilient element 36, move to the right in FIG. 14 again, and abut against the upper edge of the operating element 32 again. In other words, with the arrangement of the protective resilient element 36, the operating element 32 may selectively abut against the blocking portion 35*a*, thereby preventing the user from accidentally touching the operating element 32 and accidentally folding the baby bed 1.

Figure 17:
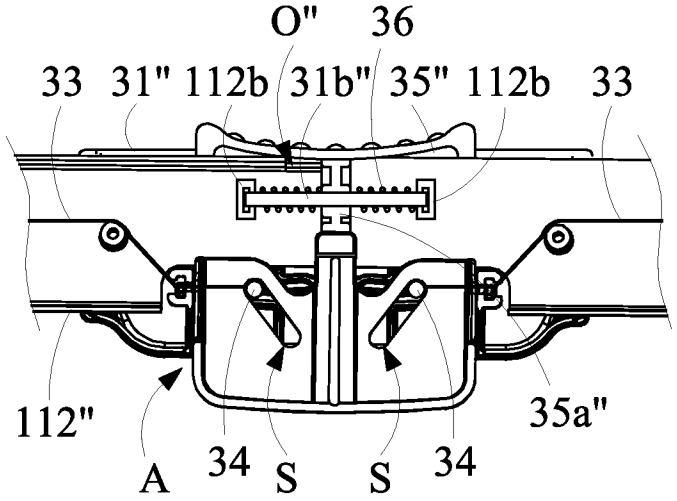
FIG. 17 is a schematic sectional view of FIG. 16.
Figure 16:
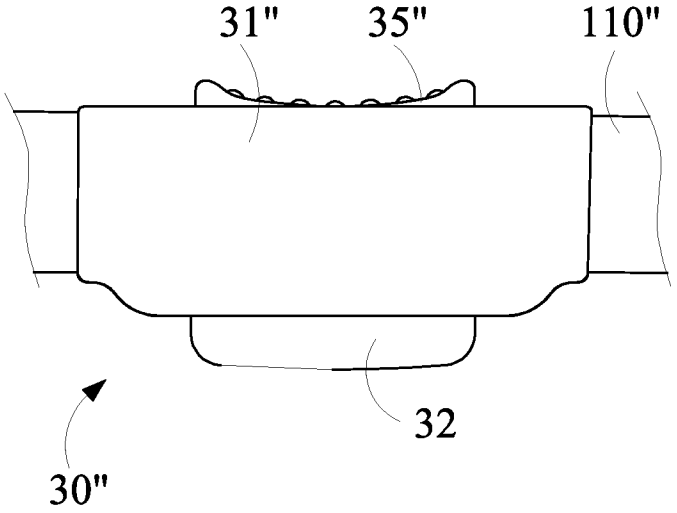
FIG. 16 is a partially enlarged schematic view of an upper frame of a baby bed according to a third embodiment of the present disclosure.

Referring to FIGS. 16 and 17, FIG. 16 is a partially enlarged schematic view of an upper frame of a baby bed according to a third embodiment of the present disclosure, and FIG. 17 is a schematic sectional view of FIG. 16. The baby bed 1 of this embodiment is similar to the baby bed 1 shown in FIG. 11, and the main difference between the both is that the operating element 32 and the protection element 35" of this embodiment are respectively arranged on opposite sides of the unlocking housing 31".

In detail, a positioning groove 112*b* is formed on an inner side of a pipe wall of the pipe body 112". In this embodiment, for example, two positioning grooves 112*b* are provided, and the two positioning grooves 112*b* are arranged at intervals in the extending direction of the first transverse portion 110". On the other hand, the supporting portion 31*b*" is, for example, a rod portion, and has two ends embedded in the positioning grooves 112*b*. In other words, the supporting portion 31*b*" extends in the extending direction of the first transverse portion 110" and is fixed relative to the pipe body 112", the protective resilient element 36 is sleeved on the supporting portion 31*b*", and the protective element 35" is fixed relative to the protective resilient element 36. Therefore, the protective element 35" may be guided and positioned by the supporting portion 31*b*", and the operating element 32 and the protective element 35" may be respectively arranged on the opposite sides of the unlocking housing 31", which is more ergonomic for hand operation.

Figure 18:
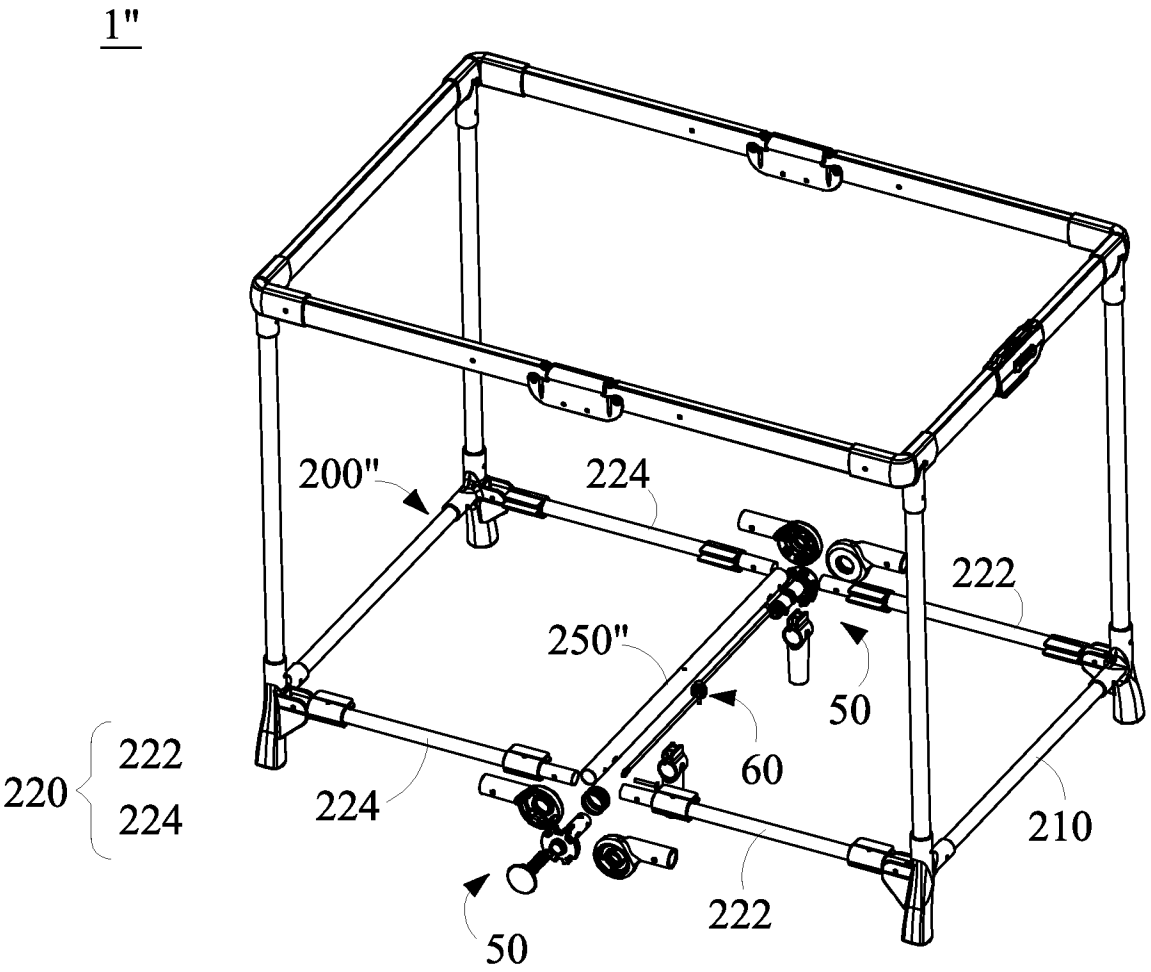
FIG. 18 is a partially exploded schematic view of a baby bed according to a fourth embodiment of the present disclosure.

Referring to FIG. 18, FIG. 18 is a partially exploded schematic view of a baby bed according to a fourth embodiment of the present disclosure. The baby bed 1" of this embodiment is similar to the baby bed 1 shown in FIG. 1, and the main difference between the both is that the baby bed 1" of FIG. 18 further includes a lower frame locking mechanism 50. In this embodiment, two lower frame locking mechanisms 50 are provided, and are respectively arranged between the third pipe section 222 and the fourth pipe section 224 on both sides of the baby bed 1".

Figure 19:
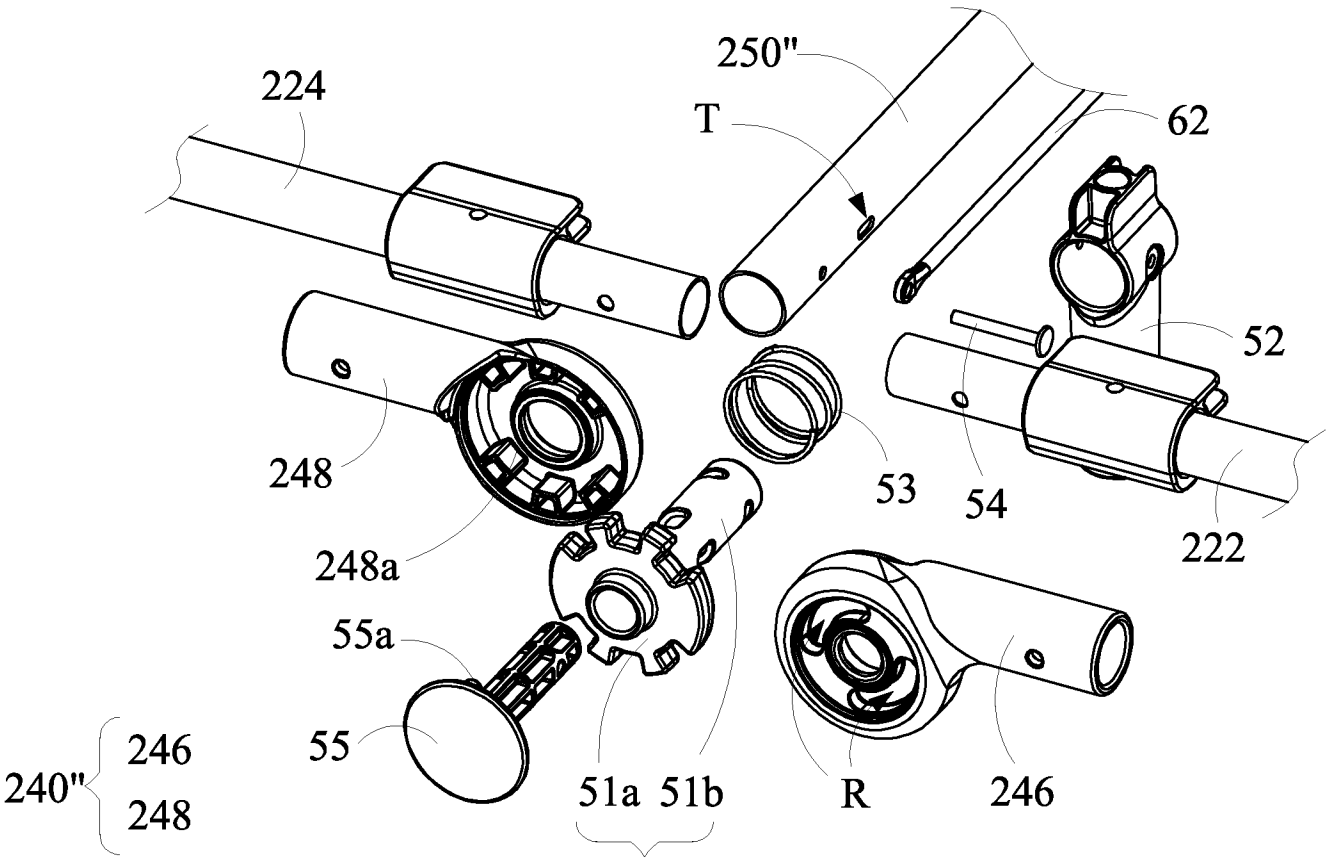
FIG. 19 is a partially enlarged schematic view of FIG. 18.
Figure 20:
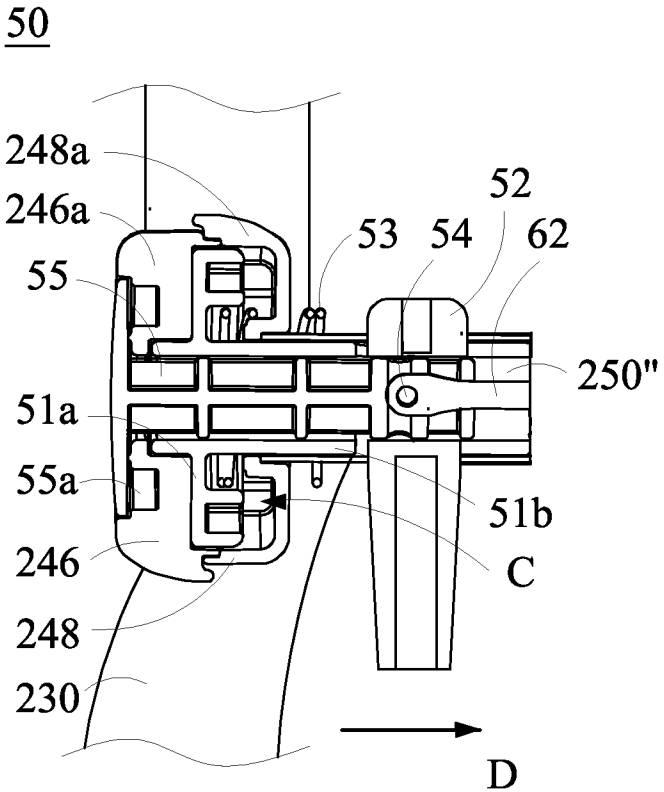
FIG. 20 is a schematic sectional view of a lower frame locking mechanism of FIG. 18 in a locking state.

In detail, compared with the embodiment in which the third pivoting portion 240 of the baby bed 1 limits the third pipe section 222 and the fourth pipe section 224 in one direction by the pivot limit portion 244, the lower frame locking mechanism 50 of this embodiment has more precise locking and unlocking functions, so that the third pipe section 222 and the fourth pipe section 224 may be fixed in the unfolded state or switched between the unfolded state and the retracted state. Referring to FIGS. 19 and 20, FIG. 19 is a partially enlarged schematic view of FIG. 18, and FIG. 20 is a schematic sectional view of a lower frame locking mechanism of FIG. 18 in a locking state. As shown, the lower frame locking mechanism 50 includes a third pivoting portion 240", a locking element 51, a lower frame operating element 52 and a lower frame resilient element 53, wherein the third pivoting portion 240" includes a third pipe housing 246 and a fourth pipe housing 248, the third pipe housing 246 is sleeved on an end of the third pipe section 222 and fixed relative to the third pipe section 222, and the fourth pipe housing 248 is sleeved on an end of the fourth pipe section 224 and fixed relative to the fourth pipe section 224. The third pipe housing 246 and the fourth pipe housing 248 jointly define a pivot cavity C, and the locking element 51 is slidably disposed in the pivot cavity C. The lower frame operating element 52 is, for example, a supporting leg for assisting the baby bed 1" to stand and is connected to the locking element 51, and the lower frame resilient element 53 is, for example, a spring and is arranged between the locking element 51 and the bottom pipe 250".

Specifically, the lower frame locking mechanism 50 is selectively engaged with (e.g., snapped with) one or both of the third pipe housing 246 and the fourth pipe housing 248 through the locking element 51 to achieve the locking or unlocking effect. As shown in FIGS. 19 and 20, the third pipe housing 246 and the fourth pipe housing 248 are dome-shaped at their respective ends, and engaging features 246*a* and 248*a* are respectively formed on an inner surface defining the pivot cavity C, wherein the engaging features 246*a* and 248*a* are, for example, bumps at corresponding positions in a circumferential direction of the pivot cavity C. On the other hand, the locking element 51 includes an engaging portion 51*a* which is a gear and has a shape corresponding to the engaging features 246*a* and 248*a*, and an extending portion 51*b* which is cylindrical and connected to the engaging portion 51*a*. The lower frame operating element 52 is fixed relative to the extending portion 51*b*. Therefore, when the third pipe section 222 and the fourth pipe section 224 are in the unfolded state, the engaging portion 51*a* is abutted by the lower frame resilient element 53 and simultaneously engaged with the engaging feature 246*a* and the engaging feature 248*a*, so that the third pipe housing 246 relatively fixed to the third pipe section 222 and the fourth pipe housing 248 relatively fixed to the fourth pipe section 224 cannot rotate relative to each other, thereby locking the third pipe section 222 and the fourth pipe section 224 in the unfolded state.

Figure 22:
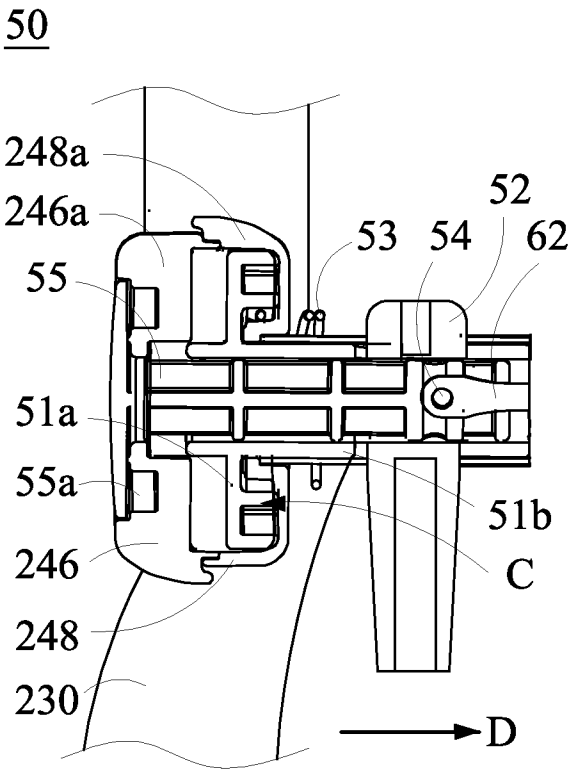
FIG. 22 is a schematic sectional view of a lower frame locking mechanism of FIG. 18 in an unlocking state.

Referring to FIG. 22, FIG. 22 is a schematic sectional view of a lower frame locking mechanism of FIG. 18 in an unlocking state. When the user intends to release the locking state of the third pipe section 222 and the fourth pipe section 224, it is only necessary to kick the lower frame operating element 52 in the transverse direction D shown in FIG. 20 for a short distance, and at this time, the locking element 51 will be driven by the lower frame operating element 52 and moved to a position as shown in FIG. 22. Thus, the engaging portion 51*a* moves to the right side of the pivot cavity C without clamping with the engaging feature 246*a*, so that the third pipe housing 246 and the fourth pipe housing 248 may become to be rotatable with each other, and at the same time, the third pipe section 222 and the fourth pipe section 224 may be unlocked. At this time, the user only needs to kick the third pivoting portion 240" upwards for a short distance, like the baby bed 1 being retracted, so that the lower frame 200" of the baby bed 1" may be switched from the unfolded state to the retracted state. When the user unfolds the third pipe section 222 and the fourth pipe section 224 again, the engaging feature 246*a* and the engaging feature 248*a* will rotate relatively to align with each other, and the engaging portion 51*a* will be reset again by the elastic force of the lower frame resilient element 53 and simultaneously engaged with the engaging feature 246*a* and the engaging feature 248*a*. In other words, the lower frame locking mechanism 50 is engaged with at least one of the engaging features 246*a* and 248*a* through the engaging portion 51*a*, thereby achieving the effect of locking and unlocking the third pipe section 222 and the fourth pipe section 224, and increasing the stability and convenience of the baby bed 1" during use.

In addition, in order to allow the user to unlock the lower frame locking mechanisms 50 on both sides at the same time, the baby bed 1" of this embodiment further includes a lower frame synchronizing mechanism 60, and the lower frame synchronizing mechanism 60 is connected between these lower frame locking mechanisms 50.

Figure 23:
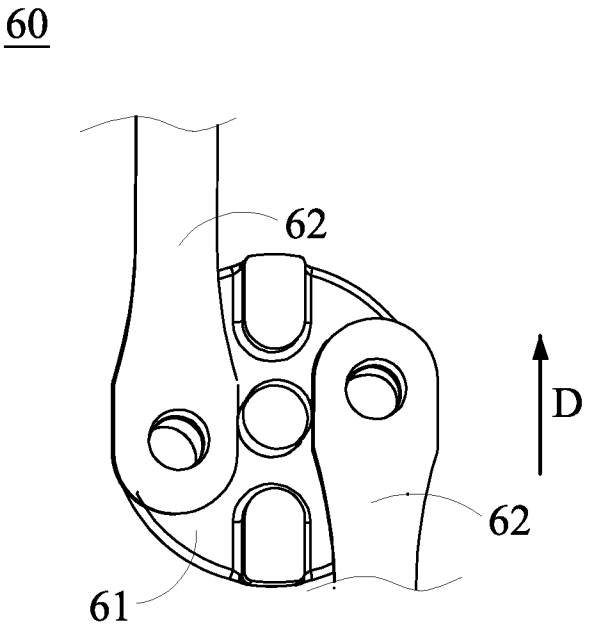
FIG. 23 is a schematic top view of the lower frame synchronizing mechanism of FIG. 18 in the unlocking state.

Together referring to FIGS. 19 to 23, FIG. 21 is a schematic top view of a lower frame synchronizing mechanism of FIG. 18 in the locking state, and FIG. 23 is a schematic top view of the lower frame synchronizing mechanism of FIG. 18 in the unlocking state. In detail, the lower frame synchronizing mechanism 60 includes a synchronizing element 61 and a plurality of linkage elements 62, wherein the synchronizing element 61 is disc-shaped or spherical, and the linkage elements 62 are rod-shaped and the number of linkage elements corresponds to that of the lower frame locking mechanisms 50. The synchronizing element 61 is pivotably connected to an end of each of these linkage elements 62, and the other end of each of these linkage elements 62 is fixedly disposed to the locking element 51 of the lower frame locking mechanism 50 on both sides, respectively.

Specifically, in this embodiment, the synchronizing element 61 is arranged in the bottom pipe 250", and is pivotably fixed at a center of the bottom pipe 250" through a locking part such as a screw or rivet penetrating through a locking hole in the center of the synchronizing element 61. On the other hand, at least a part of each of these linkages 62 is arranged in the bottom pipe 250", and the lower frame operating element 52 is sleeved on the bottom pipe 250". Furthermore, as shown in FIG. 19, the lower frame synchronizing mechanism 60 further includes a plurality of synchronous locking elements 54, wherein the synchronous locking elements 54 are rivets, and the bottom pipe 250" is formed with a plurality of synchronous limit grooves T. The number of synchronous limit grooves T corresponds to the number of locking elements 51 and a length of the synchronous limit groove corresponds to a moving length of the lower frame operating element 52 in the transverse direction D. These synchronous locking elements 54 each respectively penetrates through a slot on the extending portion 51*b* of the corresponding locking element 51, the corresponding lower frame operating element 52, the corresponding linkage element 62 and the corresponding synchronous limit groove T. In other words, the locking element 51 and the linkage element 62 are relatively fixed in the transverse direction D, but may be rotatable relatively in a circumferential direction of the extending portion 51*b*, and the locking element 51, the lower frame operating element 52 and the linkage element 62 may slide in the transverse direction D by a length of the synchronous limit groove T.

Figure 21:
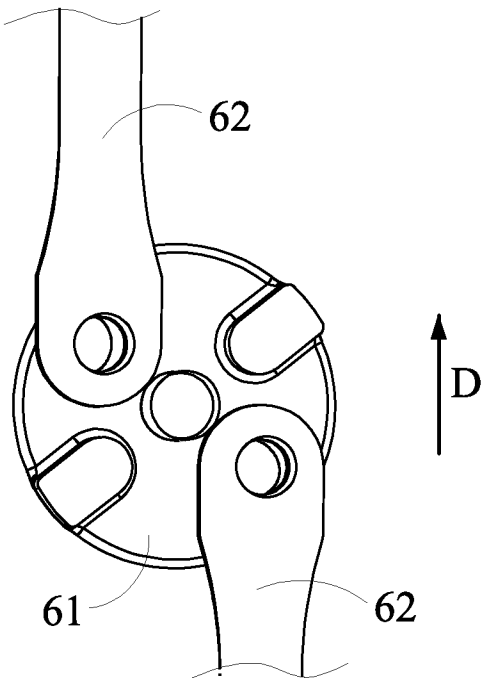
FIG. 21 is a schematic top view of a lower frame synchronizing mechanism of FIG. 18 in the locking state.

When the user unlocks one of the lower frame locking mechanisms 50 at one side as described above, the lower frame operating element 52 will drive the linkage element 62 to move together in the transverse direction D, that is, towards the center of the bottom pipe 250", and since the synchronizing element 61 is pivotably fixed at the center of the bottom pipe 250", the synchronizing element 61 will also be driven and rotated by the linkage element 62 at one side, so that the linkage element 62 at the other side moves towards the center of the bottom tube 250" in a direction opposite to the transverse direction D, rotates from a position as shown in FIG. 21 to a position as shown in FIG. 23, and drives the lower frame operating element 52 and the locking element 51 at the other side to be simultaneously unlocked. In other words, due to the linkage relationship of the locking element 51, the lower frame operating element 52, the synchronizing element 61 and the linkage element 62, the user only needs to unlock the lower frame locking mechanism 50 at one side, that is, all of the lower frame locking mechanisms 50 may be simultaneously unlocked by the lower frame synchronizing mechanism 60, saving the processes of unlocking the baby bed 1" by the user's moving to various positions, and greatly improving the convenience of operation.

Figure 25:
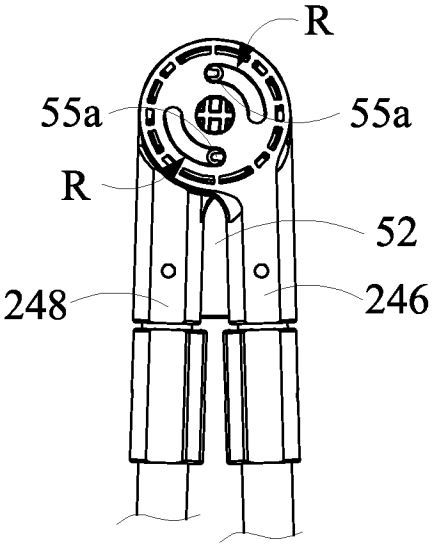
FIG. 25 is a schematic front view of the lower frame locking mechanism of FIG. 18 in a retracted state of the baby bed.
Figure 24:
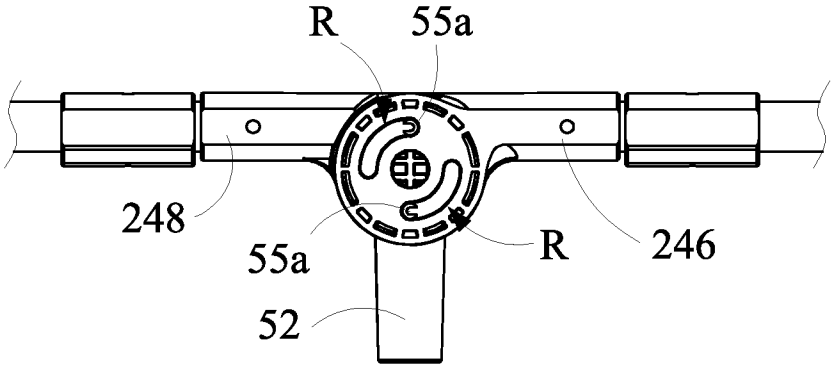
FIG. 24 is a schematic front view of the lower frame locking mechanism of FIG. 18 in an unfolded state of the baby bed.

Referring to FIGS. 19, 24 and 25, FIG. 24 is a schematic front view of the lower frame locking mechanism of FIG. 18 in an unfolded state of the baby bed, and FIG. 25 is a schematic front view of the lower frame locking mechanism of FIG. 18 in a retracted state of the baby bed. As shown, the lower frame locking mechanism 50 of this embodiment preferably further includes a pivot limit element 55, wherein the pivot limit element 55 may be a bolt with a decorative cover, and a protruding portion 55*a* is formed inside the decorative cover. On the other hand, one of the third pipe housing 246 and the fourth pipe housing 248 is formed with a pivot limit groove R. When components are assembled with each other, the bolt of the pivot limit element 55 partially penetrates into the third pipe housing 246, the fourth pipe housing 248 and the locking element 51, the decorative cover thereof partially closes one end of the pivot cavity C, and the protruding portion 55*a* is embedded in the pivot limit groove R. With this configuration, when the third pipe section 222 and the fourth pipe section 224 are switched between the unfolded state as shown in FIG. 24 and the retracted state as shown in FIG. 25, the pivot limit element 55 not only makes the appearance of the third pivoting portion 240" smooth and beautiful, but also rotates synchronously with the locking element 51. In addition, the protruding portion 55*a* is embedded in the pivot limit groove R, the rotating stroke of the locking element 51 and the pivot limit element 55 is limited to both ends of the pivot limit groove R, ensuring that the lower frame operating element 52 rotates to an appropriate position between the unfolded state and the retracted state of the baby bed 1" without hindering the retracting of the third pipe section 222 and the fourth pipe section 224.

Figure 26:
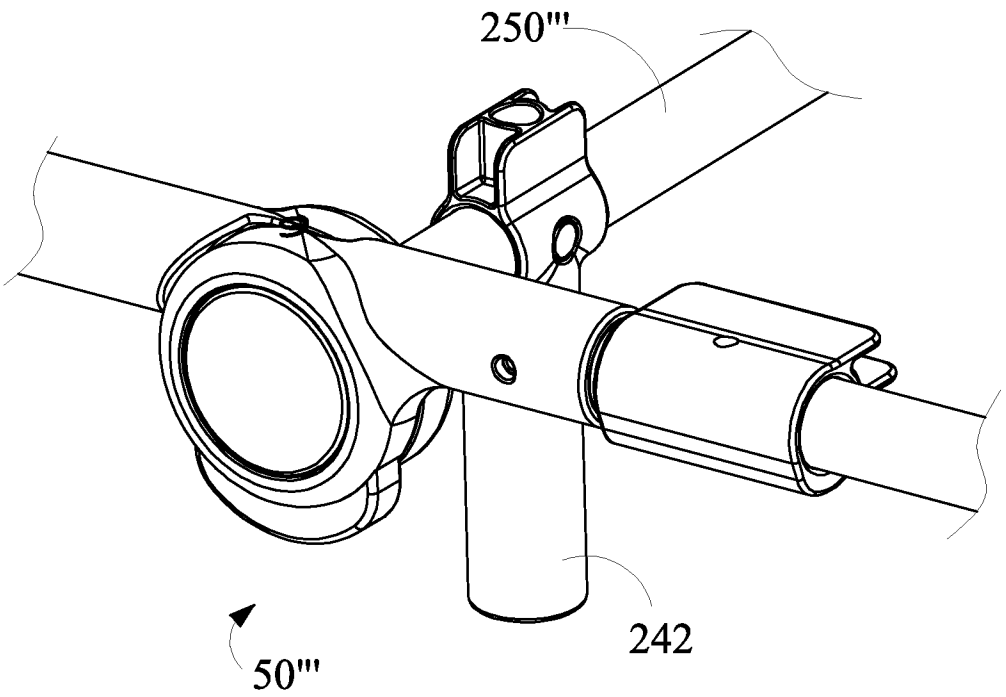
FIG. 26 is a partially enlarged schematic view of a baby bed according to a fifth embodiment of the present disclosure.
Figure 27:
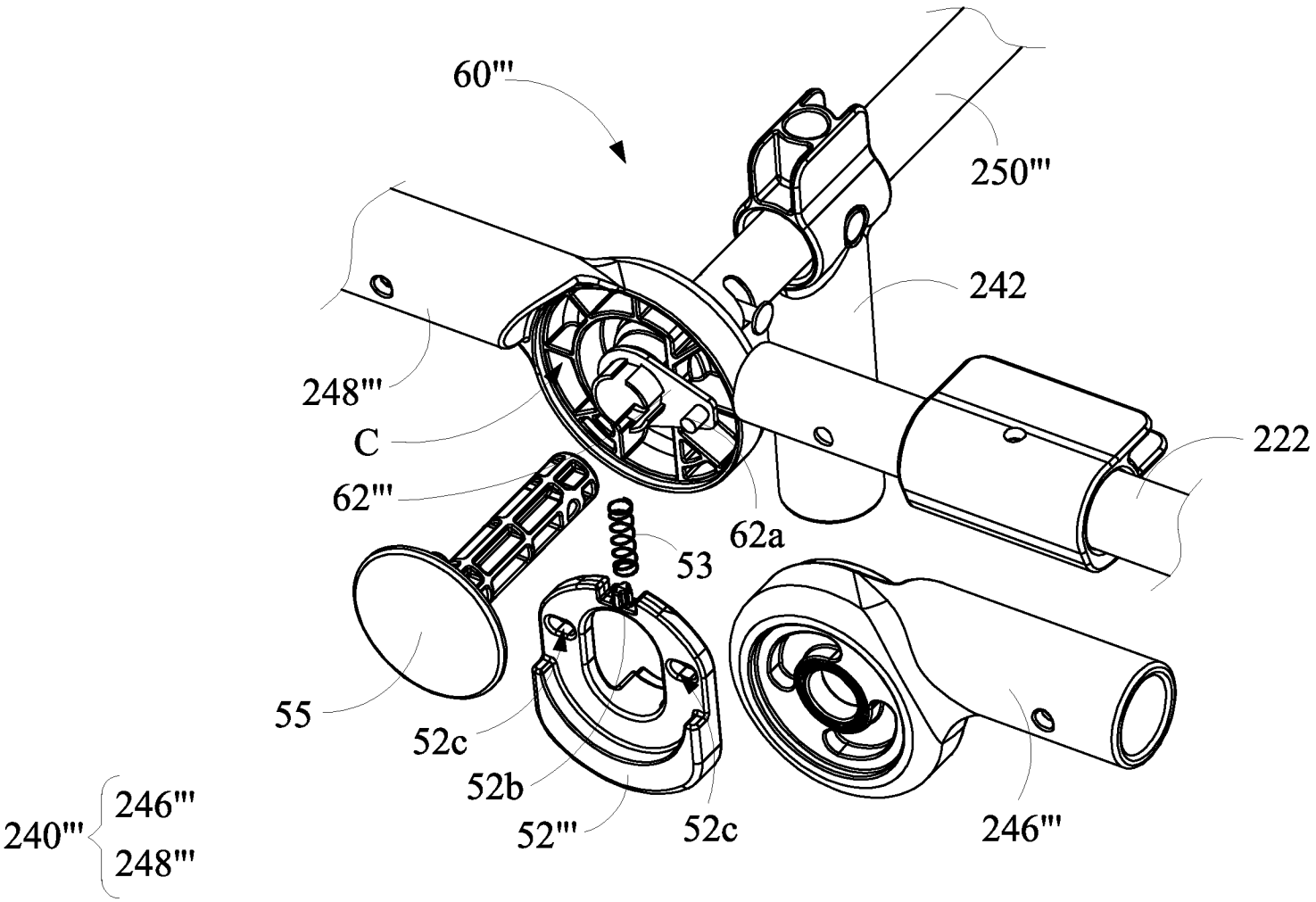
FIG. 27 is an exploded schematic view of components in FIG. 26.
Figure 29:
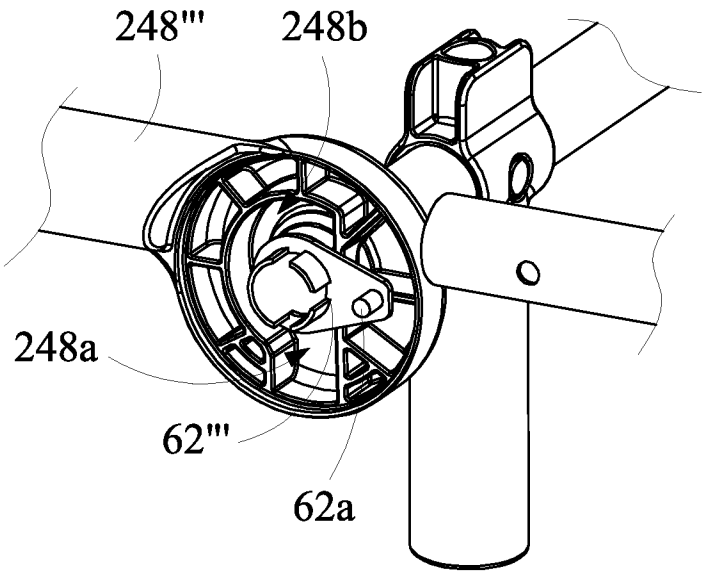
FIG. 29 is a schematic perspective view of a fourth pipe housing and a linkage element in FIG. 27 from another perspective.
Figure 28:
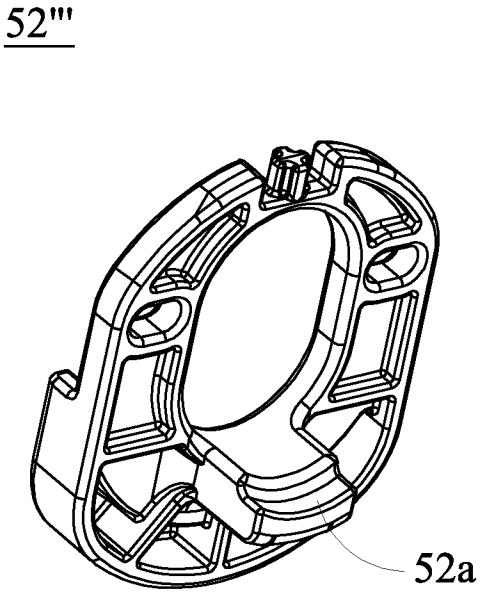
FIG. 28 is a schematic perspective view of a lower frame operating element in FIG. 27.

Referring to FIGS. 26 to 29, FIG. 26 is a partially enlarged schematic view of a baby bed according to a fifth embodiment of the present disclosure, FIG. 27 is an exploded schematic view of components in FIG. 26, FIG. 28 is a schematic perspective view of a lower frame operating element in FIG. 27, and FIG. 29 is a schematic perspective view of a fourth pipe housing and a linkage element in FIG. 27 from another perspective. The baby bed 1" of this embodiment is similar to the baby bed 1" shown in FIG. 18, and the main difference between the both is that the baby bed 1" of this embodiment may be locked and unlocked directly by the lower frame operating element 52'".

In detail, the lower frame locking mechanism 50'" of this embodiment includes a third pivoting portion 240'" and a lower frame operating element 52'", and the third pivoting portion 240'" includes a third pipe housing 246'" and a fourth pipe housing 248'". The third pipe housing 246'" is fixed relative to the third pipe section 222, and the fourth pipe housing 248'" is fixed relative to the fourth pipe section 224. The third pipe housing 246'" and the fourth pipe housing 248'" jointly define a pivot cavity C, and at least one of the third pipe housing 246'" and the fourth pipe housing 248'" is formed with an engaging feature in the pivot cavity C. In this embodiment, as an example, the fourth pipe housing 248'" is formed with an engaging feature 248*a*, and the engaging feature 248*a* is a long groove. On the other hand, the lower frame operating element 52'" is pivotably connected to the third pivoting portion 240'" and has a part exposed relative to the third pivoting portion 240'", wherein the lower frame operating element 52'" includes an engaging part 52*a*, which in this embodiment is, for example, a lug with a size corresponding to the engaging feature 248*a*, and the engaging part 52*a* is selectively clamped to the engaging feature 248*a*.

Figure 31:
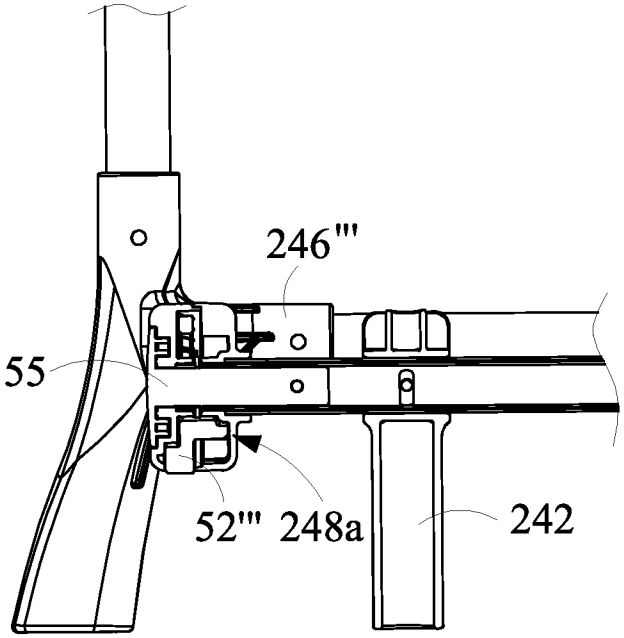
FIG. 31 is a schematic right-side sectional view of the third pivoting portion and the lower frame operating element of the baby bed of FIG. 26 in an unlocking state.
Figure 30:
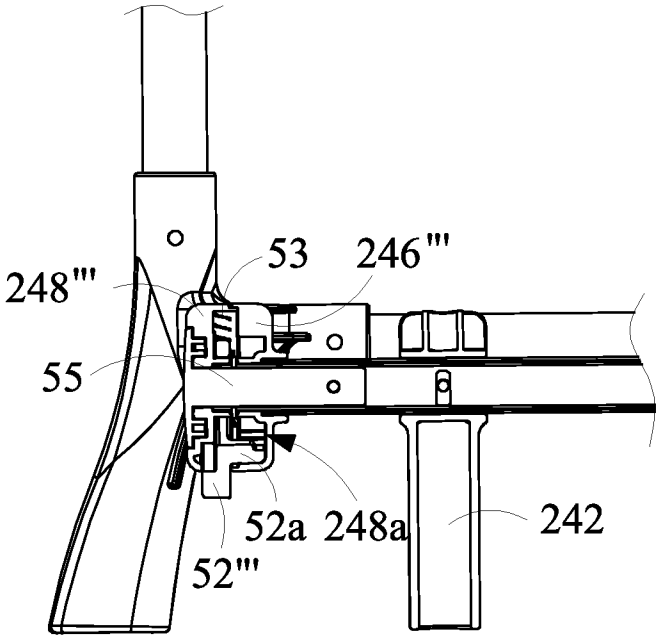
FIG. 30 is a right-side schematic sectional view of a third pivoting portion and a lower frame operating element of the baby bed of FIG. 26 in an unfolded state.

Furthermore, the fourth pipe housing 248'" is also formed with a pivot groove 248*b* in the pivot cavity C, wherein the engaging feature 248*a*, i.e., the long groove, extends in a radial direction of the fourth pipe housing 248'", the pivot groove 248*b* is arranged in a circumferential direction of the fourth pipe housing 248'" and communicated with the long groove 248*a*, and the engaging portion 52*a* is slidably disposed in the long groove 248*a* and the pivot groove 248*b*. In addition, the lower frame locking mechanism 50"" further includes a lower frame resilient element 53, and the lower frame resilient element 53 is arranged between the lower frame operating element 52'" and the third pivoting portion 240'" in an extending direction of the engaging feature 248*a*. Referring to FIGS. 30 and 31, FIG. 30 is a schematic right-side sectional view of a third pivoting portion and a lower frame operating element of the baby bed of FIG. 26 in an unfolded state, and FIG. 31 is a schematic right-side sectional view of the third pivoting portion and the lower frame operating element of the baby bed of FIG. 26 in an unlocking state. As shown, when the baby bed 1" is in the unfolded state, the lower frame operating element 52'" is abutted by the lower frame resilient element 53, and the engaging portion 52*a* is clamped in the engaging feature 248*a*, so that the third pipe housing 246'" and the fourth pipe housing 248'" cannot pivot relative to each other, thereby locking the lower frame 200" in the unfolded state. When the user intends to fold the baby bed 1", it is only necessary to kick the lower frame operating element 52'" upwards for a certain distance in the extending direction of the engaging feature 248*a*, and at this time, the engaging portion 52*a* will move from the engaging feature 248*a* into the pivot groove 248*b* and may slide along the circumferential direction of the pivot groove 248*b* relative to the fourth pipe housing 248'''. Thus, the third pipe housing 246''' and the fourth pipe housing 248''' are unlocked and may freely pivot relative to each other.

In addition, the baby bed 1'' of this embodiment also has a function of synchronously unlocking a plurality of lower frame locking mechanisms 50'''. As shown in FIG. 27, the baby bed 1'' further includes a plurality of lower frame synchronizing mechanisms 60'''. In this embodiment, for example, two second longitudinal portions 220 and two lower frame synchronizing mechanisms 60''' are provided, and each of the lower frame synchronizing mechanisms 60''' corresponds to a corresponding lower frame locking mechanism 50''' and includes a linkage element 62''', wherein the linkage element 62''' may be pivotably arranged in the pivot cavity C and clamped to the lower frame operating element 52'''. In detail, the lower frame operating element 52''' is formed with a clamping portion 52*c*, wherein the clamping portion 52*c* is a hole, for example, and the linkage element 62''' is formed with a protruding column 62*a*, and the protruding column 62*a* is clamped in the clamping portion 52*c*. On the other hand, the lower frame 200'' further includes a bottom pipe 250''' connected to third pivoting portions 240''' of the lower frame locking mechanisms 50''' and fixed relative to the linkage elements 62''' of the lower frame synchronizing mechanisms 60'''. Thus, when the user kicks the lower frame operating element 52''' upwards for a certain distance in the extending direction of the engaging feature 248*a* as described above, the linkage element 62''' will be driven by the lower frame operating element 52''' and pivots relative to the fourth pipe housing 248''' to further drive the bottom pipe 250''' connected to the other third pivoting portions 240''' to be pivoted synchronously, so that the other third pivoting portions 240''' have the same movement mode, so as to achieve the effect of synchronous unlocking.

Figure 32:
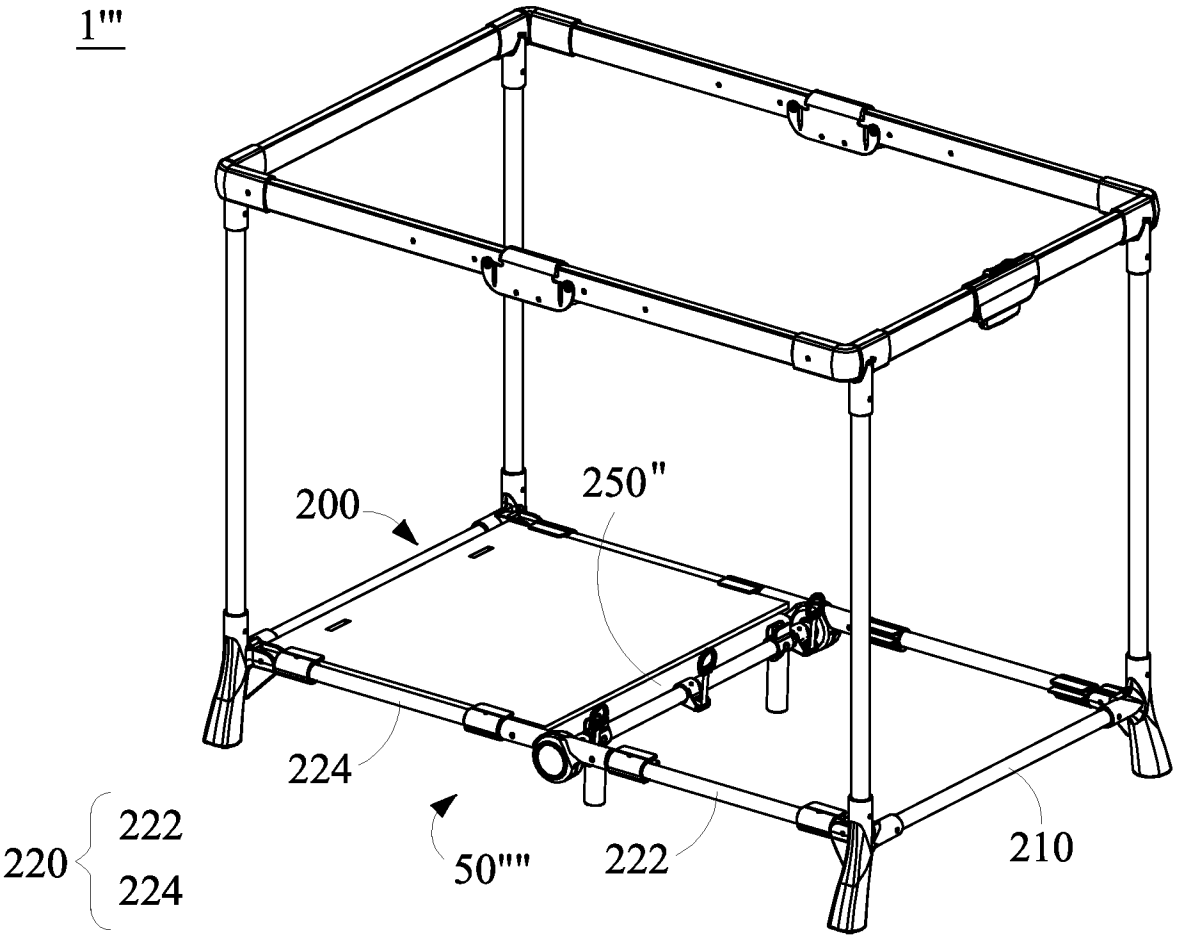
FIG. 32 is a schematic perspective view of a baby bed according to a sixth embodiment of the present disclosure.
Figure 33:
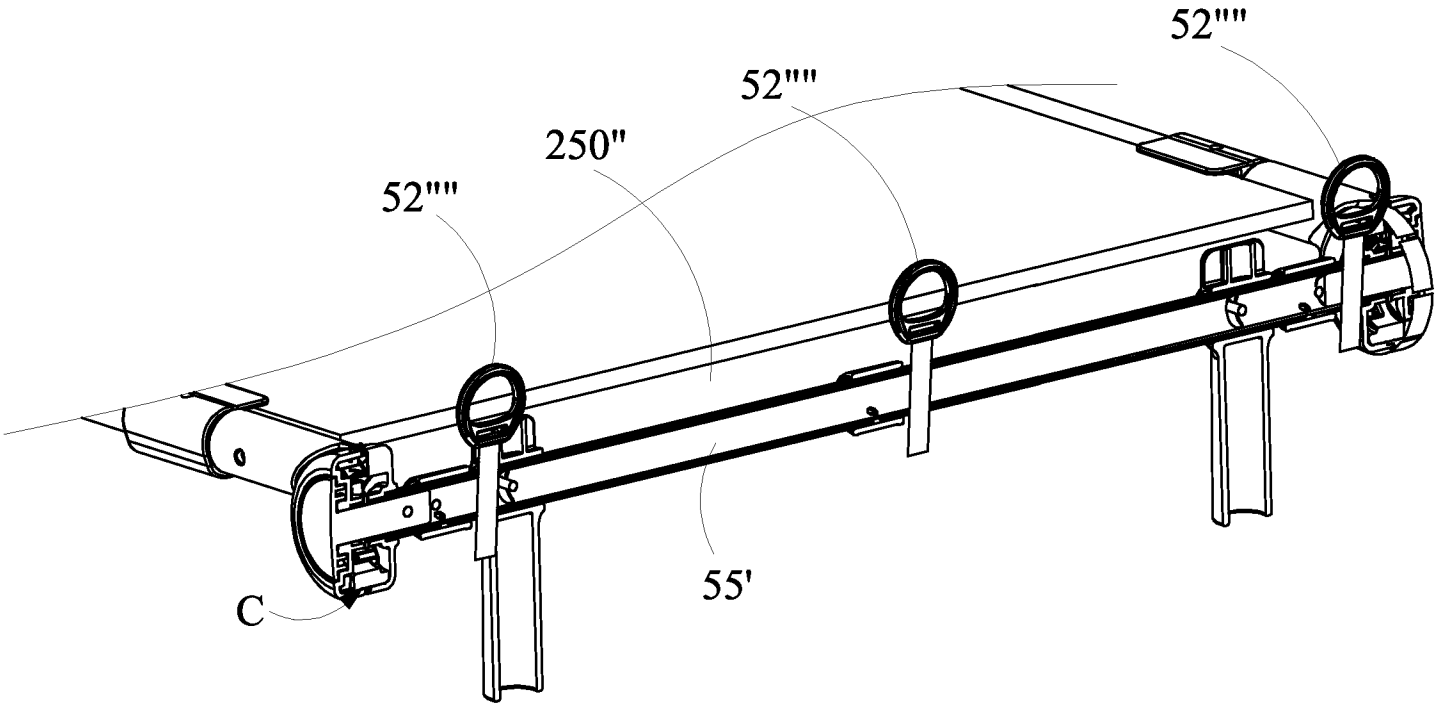
FIG. 33 is a schematic sectional view of the baby bed in FIG. 32.
Figure 34:
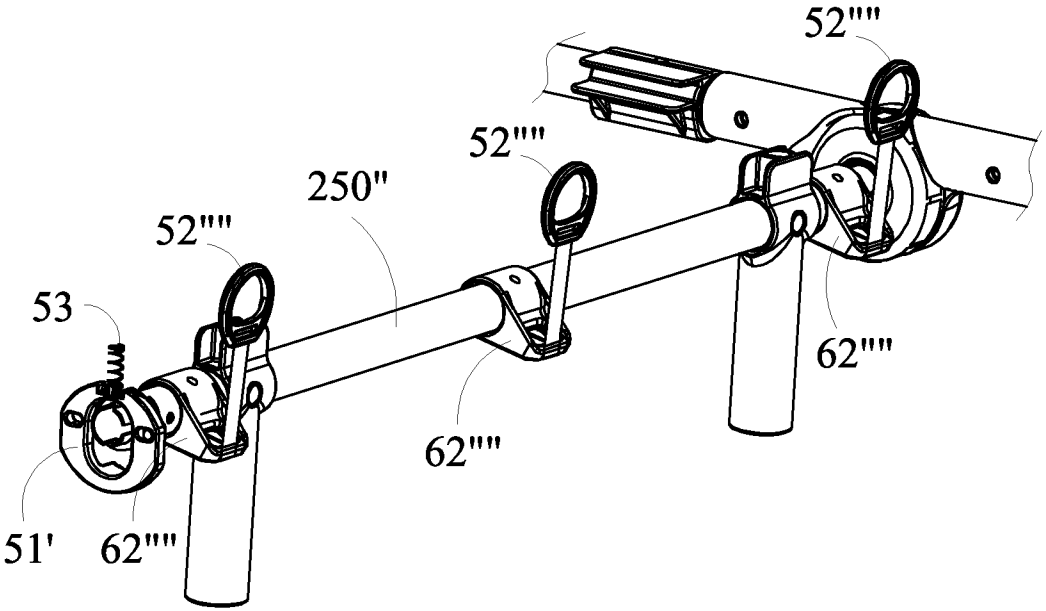
FIG. 34 is an exploded view of components of the baby bed in FIG. 32.
Figure 36:
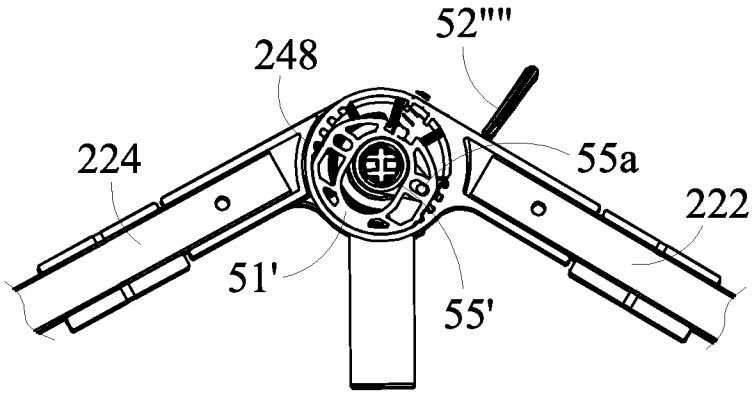
FIG. 36 is a schematic front sectional view of the baby bed of FIG. 32 in the unlocking state.
Figure 35:
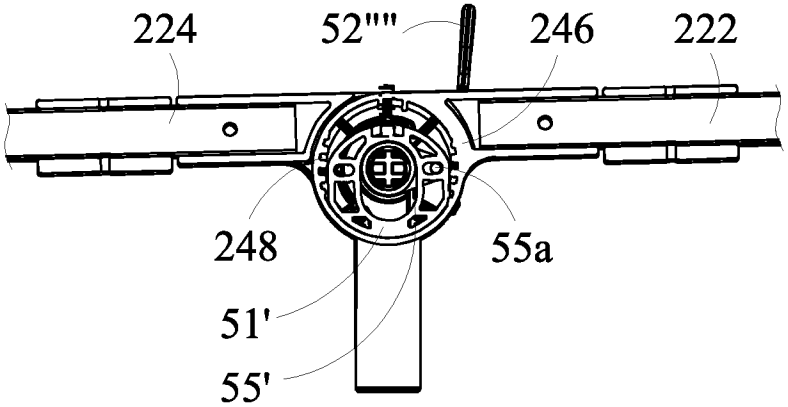
FIG. 35 is a schematic front sectional view of the baby bed of FIG. 32 in a locking state.

Referring to FIGS. 32 to 36, FIG. 32 is a schematic perspective view of a baby bed according to a sixth embodiment of the present disclosure, FIG. 33 is a schematic sectional view of the baby bed of FIG. 32, FIG. 34 is an exploded schematic view of the baby bed of FIG. 32, FIG. 35 is a front sectional view of the baby bed of FIG. 32 in a locking state, and FIG. 36 is a schematic front sectional view of the baby bed of FIG. 32 in the unlocking state. The baby bed 1''' of this embodiment is similar to the baby bed 1'' of the fifth embodiment, and the main difference between the both is that the lower frame locking mechanism 50'''' of this embodiment includes a third pivoting portion 240'' and a lower frame operating portion, wherein the lower frame operating portion includes a plurality of lower frame operating elements 52'''', and the user may operate any of these lower frame operating elements 52'''' to unlock the baby bed 1'''.

In detail, the lower frame operating element includes a clamping element 51', a pivot element 55' and a plurality of lower frame operating elements 52'''', wherein the clamping element 51' is slidably disposed in the pivot cavity C and is selectively clamped with the engaging feature 248*a*, the pivot element 55' is pivotably connected to the clamping element 51', and these lower frame operating elements 52'''' are connected to the pivot element 55' and at least partially exposed relative to the third pivoting portion 240''.

As shown in FIG. 33, the pivot element 55' of this embodiment is, for example, a tubular member penetrating through the bottom pipe 250'', and an end of the pivot element 55' is arranged in the pivot cavity C and clamped with the clamping element 51'. On the other hand, the lower frame operating element further includes a plurality of linkage elements 62'''' sleeved on the bottom pipe 250'' and fixed relative to the pivot element 55', wherein the number of the lower frame operating elements 52'''' corresponds to the number of the linkage elements 62'''', and these lower frame operating elements 52'''' are respectively arranged on the corresponding linkage elements 62''''. Thus, when the user pulls and lifts any of the lower frame operating element 52'''', the lower frame operating element 52'''' will drive the pivot element 55' to pivot through the linkage element 62'''', and thus the clamping element 51' clamped with the pivot element 55' slides along the extending direction of the engaging feature 248*a* and is no longer clamped with the engaging feature 248*a*, so that it may be switched from the locking state of FIG. 35 to the unlocking state of FIG. 36. When the user no longer pulls and lifts the lower frame operating element 52'''', the clamping element 51' will drive the pivot element 55' to return to a position where it is in the locking state due to the elastic force of the lower frame resilient element 53.

It is worth mentioning, although the linkage element 62'''' is sleeved outside of the bottom pipe 250'' in this embodiment, the present disclosure is not limited thereto. In other possible embodiments, the linkage element 62'''' may completely cover the inside of the bottom pipe 250'', and the bottom pipe 250'' may be exposed only from the lower frame operating element 52'''' for the user's operation.

Compared with the related art, the baby bed 1 of the present disclosure includes a locking mechanism 20 and an unlocking mechanism 30, which can lock the frame body 10 in the unfolded state or release the above-mentioned locking state. In addition, through the pivoting relationship between the components of the frame body 10, the user can unlock, fold and retract the baby bed 1 with one hand, without disassembling the components one by one, thereby greatly saving the time required to retract the baby bed 1 and improving the convenience in use.

The present disclosure has been described in connection with the above preferred embodiments, however, the present disclosure is not limited to the above disclosed embodiments, and should cover various modifications and equivalent combinations according to the essence of the present disclosure.

What is claimed is:

1. A baby bed comprising:

a frame body comprising:

an upper frame comprising a first transverse portion, a first longitudinal portion and a first pivoting portion, the first longitudinal portion being pivotally connected to the first transverse portion through the first pivoting portion and comprising a first pipe section and a second pipe section;

a lower frame comprising a second transverse portion, a second longitudinal portion and a second pivoting portion, the second longitudinal portion being pivotally connected to the second transverse portion through the second pivoting portion and comprising a third pipe section and a fourth pipe section, and the third pipe section and the fourth pipe section being pivotally connected with each other; and a side rod connected to the first pivoting portion and the second pivoting portion;

a locking mechanism connected between the first pipe section and the second pipe section, the first pipe section and the second pipe section being fixed relative to the locking mechanism when the locking mechanism is in a locking state, and the first pipe section and the second pipe section being rotatable relative to the locking mechanism when the locking mechanism is in an unlocking state; and an unlocking mechanism arranged on the first transverse portion and comprising an operating element and a driving element, and the operating element being connected to the locking mechanism through the driving element;

wherein when the locking mechanism is in a locking state, an extending direction of the first longitudinal portion is parallel to the second longitudinal portion, the extending direction extending between a first end and an opposite second end of the first longitudinal portion.

2. The baby bed according to claim 1, wherein the locking mechanism includes a locking housing, a limit element and a connecting element, wherein the limit element is fixed relative to the locking housing, and the connecting element is slidably disposed on the limit element and selectively clamped to one of the first pipe section and the second pipe section.

3. The baby bed according to claim 2, wherein another one of the first pipe section and the second pipe section comprises an actuating element, a positioning portion and a reset resilient element, the driving element is connected to the operating element and the actuating element, and the reset resilient element is connected between an end of the actuating element and the positioning portion.

4. The baby bed according to claim 3, wherein the locking mechanism further comprises a linkage resilient element, and the linkage resilient element is arranged between another end of the actuating element and the connecting element.

5. The baby bed according to claim 1, wherein the first transverse portion comprises a pipe body, an operating hole is formed on the pipe body, the unlocking mechanism further comprises an unlocking housing and a protective element, the unlocking housing is provided with an opening and an accommodating hole, the unlocking housing is sleeved on the pipe body, the protective element penetrates through the operating hole and has a part exposed through the opening, the protective element comprises a blocking portion, and the operating element penetrates through the accommodating hole and selectively abuts against the blocking portion.

6. The baby bed according to claim 5, wherein the unlocking mechanism further comprises a protective resilient element, the unlocking housing further comprises a supporting portion, and the protective resilient element is arranged between the protective element and the supporting portion.

7. The baby bed according to claim 6, wherein the supporting portion extends in an extending direction of the first transverse portion and is fixed relative to the pipe body, the protective resilient element is sleeved on the supporting portion, and the protective element is fixed relative to the protective resilient element.

8. The baby bed according to claim 1, wherein the unlocking mechanism further comprises an unlocking housing and at least one positioning element, at least one limit portion is formed on the unlocking housing, at least one sliding groove is formed on the operating element, the positioning element is slidably disposed in the limit portion and the sliding groove, and the driving element is connected to the positioning element.

9. The baby bed according to claim 1, wherein the baby bed further comprises:

a lower frame locking mechanism comprising:

a third pivoting portion comprising a third pipe housing and a fourth pipe housing, the third pipe housing being fixed relative to the third pipe section, the fourth pipe housing being fixed relative to the fourth pipe section, the third pipe housing and the fourth pipe housing jointly defining a pivot cavity, and at least one of the third pipe housing and the fourth pipe housing being formed with an engaging feature in the pivot cavity;

a locking element slidably disposed in the pivot cavity and comprising an engaging portion and an extending portion, the engaging portion is selectively engaged with the engaging feature, and the extending portion being connected to the engaging portion; and a lower frame operating element fixed relative to the extending portion.

10. The baby bed according to claim 9, wherein a plurality of second longitudinal portions and a plurality of lower frame locking mechanisms are provided, and the baby bed further comprises:

a lower frame synchronizing mechanism comprising a synchronizing element and a plurality of linkage elements, the synchronizing element being pivotably connected to the plurality of linkage elements, and the plurality of linkage elements being fixedly disposed on the locking elements of the plurality of lower frame locking mechanisms, respectively.

11. The baby bed according to claim 10, wherein the lower frame further comprises a bottom pipe connected to the third pivoting portion and arranged in parallel with the second transverse portion, at least a part of the linkage elements and the synchronizing element are arranged in the bottom pipe, and the lower frame operating element is sleeved on the bottom pipe.

12. The baby bed according to claim 11, wherein the bottom pipe is formed with a plurality of synchronous limit grooves, and the lower frame synchronizing mechanism further comprises a plurality of synchronous locking elements which penetrate through the corresponding locking elements, lower frame operating element, linkage elements and synchronous limit grooves.

13. The baby bed according to claim 9, wherein the lower frame further comprises a bottom pipe connected to the third pivoting portion and arranged in parallel with the second transverse portion, and the lower frame locking mechanism further comprises a lower frame resilient element arranged between the locking element and the bottom pipe.

14. The baby bed according to claim 9, wherein the lower frame locking mechanism further comprises a pivot limit element formed with a protruding portion, and one of the third pipe housing and the fourth pipe housing is formed with a pivot limit groove, and the protruding portion is embedded in the pivot limit groove.

15. The baby bed according to claim 1, wherein the baby bed further comprises:

a lower frame locking mechanism comprising:

a third pivoting portion comprising a third pipe housing and a fourth pipe housing, the third pipe housing being fixed relative to the third pipe section, and the fourth pipe housing being fixed relative to the fourth pipe section, the third pipe housing and the fourth pipe housing jointly defining a pivot cavity, and at least one of the third pipe housing and the fourth pipe housing is formed with an engaging feature in the pivot cavity; and a lower frame operating element pivotably connected to the third pivoting portion and having a part exposed relative to the third pivoting portion, the lower frame operating element comprising an engaging portion, and the engaging portion and the engaging feature being selectively clamped with each other.

16. The baby bed according to claim 15, wherein the engaging feature is a long groove extending in a radial direction of at least one of the third pipe housing and the fourth pipe housing, at least one of the third pipe housing and the fourth pipe housing is also formed with a pivot groove in the pivot cavity, the pivot groove is arranged in a circumferential direction of at least one of the third pipe housing and the fourth pipe housing and is communicated with the long groove, and the engaging portion is slidably disposed in the long groove and the pivot groove.

17. The baby bed according to claim 15, wherein the lower frame locking mechanism further comprises a lower frame resilient element arranged between the lower frame operating element and the third pivoting portion in an extending direction of the engaging feature.

18. The baby bed according to claim 15, wherein a plurality of second longitudinal portions and a plurality of lower frame locking mechanisms are provided, and the baby bed further comprises:

a plurality of lower frame synchronizing mechanisms, each of which corresponds to a corresponding lower frame locking mechanism and comprises a linkage element, the linkage element being pivotably arranged in the pivot cavity and clamped to the lower frame operating element;

wherein the lower frame further comprises a bottom pipe connected to the third pivoting portions of the plurality of lower frame locking mechanisms and fixed relative to the linkage elements of the plurality of lower frame synchronizing mechanisms.

19. The baby bed according to claim 1, wherein the baby bed further comprises:

a lower frame locking mechanism comprising:

a third pivoting portion comprising a third pipe housing and a fourth pipe housing, the third pipe housing being fixed relative to the third pipe section, and the fourth pipe housing is fixed relative to the fourth pipe section, the third pipe housing and the fourth pipe housing jointly defining a pivot cavity, and at least one of the third pipe housing and the fourth pipe housing being formed with an engaging feature in the pivot cavity; and a lower frame operating portion comprising a clamping element, a pivot element and a plurality of lower frame operating elements, the clamping element being slidably disposed in the pivot cavity and selectively clamped with the engaging feature, the pivot element being pivotably connected to the clamping element, and the plurality of lower frame operating elements are connected to the pivot element and the lower frame operating elements are at least partially exposed relative to the third pivoting portion.

20. The baby bed according to claim 19, wherein a plurality of third pivoting portions are provided, the lower frame further comprises a bottom pipe connected between the plurality of third pivoting portions, the pivot element penetrates through the bottom pipe, and an end of the pivot element is arranged in the pivot cavity.

21. The baby bed according to claim 20, wherein the lower frame operating portion further comprises a plurality of linkage elements sleeved on the bottom pipe and fixed relative to the pivot element, and the plurality of lower frame operating elements are arranged on the plurality of linkage elements.

22. The baby bed according to claim 19, wherein the lower frame operating portion further comprises a lower frame resilient element arranged between the clamping element and the third pivoting portion.

23. The baby bed according to claim 1, wherein a length of the first pipe section is equal to a length of the second pipe section, and a length of the third pipe section is equal to a length of the fourth pipe section.

24. The baby bed according to claim 1, wherein a length of the first transverse portion is smaller than a length of the first longitudinal portion, and a length of the second transverse portion is smaller than a length of the second longitudinal portion.

25. A baby bed comprising:

a frame body comprising:

an upper frame comprising a first transverse portion, a first longitudinal portion and a first pivoting portion, the first longitudinal portion being pivotally connected to the first transverse portion through the first pivoting portion and comprising a first pipe section and a second pipe section;

a lower frame comprising a second transverse portion, a second longitudinal portion and a second pivoting portion, the second longitudinal portion being pivotally connected to the second transverse portion through the second pivoting portion and comprising a third pipe section and a fourth pipe section, and the third pipe section and the fourth pipe section being pivotally connected with each other;

a side rod connected to the first pivoting portion and the second pivoting portion;

a locking mechanism connected between the first pipe section and the second pipe section, the first pipe section and the second pipe section being fixed relative to the locking mechanism when the locking mechanism is in a locking state, and the first pipe section and the second pipe section being rotatable relative to the locking mechanism when the locking mechanism is in an unlocking state; and an unlocking mechanism arranged on the first transverse portion and comprising an operating element and a driving element, and the operating element being connected to the locking mechanism through the driving element, wherein the unlocking mechanism further comprises an unlocking housing and at least one positioning element, at least one sliding groove is formed on the operating element, the positioning element is slidably disposed in the sliding groove, and the driving element is connected to the positioning element, wherein a part of the driving element is embedded in the first transverse portion, and an extending direction of the sliding groove is inclined relative to an extending direction of the first transverse portion.

26. A baby bed comprising:

a frame body comprising:

an upper frame comprising a first transverse portion, a first longitudinal portion and a first pivoting portion, the first longitudinal portion being pivotally connected to the first transverse portion through the first pivoting portion and comprising a first pipe section and a second pipe section;

a lower frame comprising a second transverse portion, a second longitudinal portion and a second pivoting portion, the second longitudinal portion being pivotally connected to the second transverse portion through the second pivoting portion and comprising a third pipe section and a fourth pipe section, and the third pipe section and the fourth pipe section being pivotally connected with each other; and a side rod connected to the first pivoting portion and the second pivoting portion;

a locking mechanism connected between the first pipe section and the second pipe section, the first pipe section and the second pipe section being fixed relative to the locking mechanism when the locking mechanism is in a locking state, and the first pipe section and the second pipe section being rotatable relative to the locking mechanism when the locking mechanism is in an unlocking state; and an unlocking mechanism arranged on the first transverse portion and comprising an operating element and a driving element, and the operating element being connected to the locking mechanism through the driving element, wherein the lower frame further comprises a third pivoting portion and a bottom pipe, the third pivoting portion is connected between the third pipe section and the fourth pipe section and comprises a pivot limit portion, the bottom pipe is arranged in parallel with the second transverse portion, and an end of the bottom pipe is connected to the third pivoting portion.

* * * * *